US009970438B2

(12) United States Patent
Kim et al.

(10) Patent No.: US 9,970,438 B2
(45) Date of Patent: May 15, 2018

(54) SCROLL COMPRESSOR

(71) Applicant: LG ELECTRONICS INC., Seoul (KR)

(72) Inventors: Suchul Kim, Seoul (KR); Kiwon Park, Seoul (KR); Honggyun Jin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 401 days.

(21) Appl. No.: 14/748,464

(22) Filed: Jun. 24, 2015

(65) Prior Publication Data

US 2015/0369246 A1 Dec. 24, 2015

(30) Foreign Application Priority Data

Jun. 24, 2014 (KR) ..... 10-2014-0077556

(51) Int. Cl.
*F04C 18/02* (2006.01)
*F04C 29/00* (2006.01)
(Continued)

(52) U.S. Cl.
CPC ..... *F04C 18/0215* (2013.01); *F01C 17/066* (2013.01); *F04C 18/0246* (2013.01);
(Continued)

(58) Field of Classification Search
CPC .. F04C 18/0215; F04C 23/008; F04C 27/005; F04C 29/0057; F04C 18/0253;
(Continued)

(56) References Cited

U.S. PATENT DOCUMENTS 5,833,443 A * 11/1998 Lifson ..... F04C 18/0284 418/55.2
2014/0134031 A1* 5/2014 Doepker ..... F04C 29/126 418/55.1

FOREIGN PATENT DOCUMENTS

CN 102016319 4/2011
CN 102076962 5/2011
(Continued)

OTHER PUBLICATIONS

Chinese Office Action dated Feb. 28, 2017 issued in Application No. 201510283538.2 (with English Translation).

*Primary Examiner* — Mark Laurenzi
*Assistant Examiner* — Wesley Harris
(74) *Attorney, Agent, or Firm* — Ked & Associates LLP

(57) ABSTRACT

A scroll compressor is provided that may include a casing including a rotational shaft, a cover fixed inside of the casing to partition the inside of the casing into a suction space and a discharge space, a first scroll that is revolved by rotational of the rotational shaft, a second scroll disposed on or at a side of the first scroll to define a plurality of compression chambers together with the first scroll, the second scroll having an intermediate pressure discharge hole that communicates with a compression chamber having an intermediate pressure of the plurality of compression chambers, a back pressure plate coupled to the second scroll, the back pressure plate having an intermediate pressure suction hole that communicates with the intermediate pressure discharge hole, and a floating plate movably disposed on or at a side of the back pressure plate to define the back pressure chamber together with the back pressure plate. The discharge space may have a volume greater by a set ratio or more than a volume of the back pressure chamber.

22 Claims, 19 Drawing Sheets

(51) Int. Cl.

| | |
|---|---|
| ***F01C 17/06*** | (2006.01) |
| ***F04C 28/26*** | (2006.01) |
| ***F04C 27/00*** | (2006.01) |
| ***F04C 23/00*** | (2006.01) |
| ***F04C 28/08*** | (2006.01) |
| ***F04C 28/10*** | (2006.01) |
| ***F04C 28/06*** | (2006.01) |

(52) U.S. Cl.
CPC ..... *F04C 18/0253* (2013.01); *F04C 18/0269* (2013.01); *F04C 27/005* (2013.01); *F04C 28/06* (2013.01); *F04C 28/10* (2013.01); *F04C 28/26* (2013.01); *F04C 29/0057* (2013.01); *F04C 18/0284* (2013.01); *F04C 23/008* (2013.01)

(58) Field of Classification Search
CPC .. F04C 18/0269; F04C 28/26; F04C 18/0246; F01C 17/066
See application file for complete search history.

(56) References Cited

FOREIGN PATENT DOCUMENTS

| | | |
|---|---|---|
| CN | 103104486 | 5/2013 |
| JP | 7-217559 | 8/1995 |
| KR | 10-2003-0044241 | 6/2003 |
| KR | 10-2000-0037517 | 5/2007 |
| KR | 10-1378886 | 3/2014 |

* cited by examiner

- Related Art -

SCROLL COMPRESSOR

CROSS-REFERENCE TO RELATED APPLICATION(S)

The present application claims priority under 35 U.S.C. 119 and 35 U.S.C. 365 to Korean Patent Application No. 10-2014-0077556, filed in Korea on Jun. 24, 2014, which is hereby incorporated by reference in its entirety.

BACKGROUND

1. Field

A scroll compressor is disclosed herein.

2. Background

A scroll compressor is a compressor that includes a fixed scroll having a spiral wrap and an orbiting scroll that revolves with respect to the fixed scroll, that is, a compressor in which the fixed scroll and the orbiting scroll are engaged with each other. The orbiting scroll revolves with respect to the fixed scroll, thereby reducing a volume of a compression chamber, which is formed between the fixed scroll and the orbiting scroll according to an orbiting motion of the orbiting scroll, thus increasing a pressure of a fluid, which is then discharged through a discharge hole formed in a central portion of the fixed scroll.

Such a scroll compressor has a feature in which suction, compression, and discharge of a fluid are successively performed while the orbiting scroll revolves. Accordingly, a discharge valve and a suction valve may be unnecessary in principle. Also, as components of the scroll compressor is less in number in comparison to other types of compressors, the scroll compressor may be simplified in structure and rotate at a high speed. Also, as a variation in torque required for compression is less, and suction and compression successively occur, a relatively small amount of noise and vibration may occur in comparison to other types of compressors.

One important issue in the scroll compressor is leakage and lubrication between the fixed scroll and the orbiting scroll. That is, to prevent a refrigerant from leaking between the fixed scroll and the orbiting scroll, an end of the wrap has to be closely attached to a surface of a head plate to prevent the compressed refrigerant from leaking. The head plate may refer to a portion that corresponds to a main body of the fixed scroll or the orbiting scroll. That is, a head plate of the fixed scroll may be closely attached to a wrap of the orbiting scroll, and a head plate of the orbiting scroll may be closely attached to a wrap of the fixed scroll.

On the other hand, friction resistance has to be minimized so as to allow the orbiting scroll to smoothly revolve with respect to the fixed scroll. However, leakage may conflict with lubrication. That is, when the end of the wrap and a surface of the head plate are strongly attached to each other, it may be advantageous with respect to leakage, but friction may increase, increasing damage due to noise and abrasion. On the other hand, when an adhesion strength is low, friction may be reduced, but a sealing force may decrease, increasing leakage.

Thus, according to the related art, a back pressure chamber having an intermediate pressure, which is between a discharge pressure and a suction pressure, may be formed in a back surface of the orbiting scroll or the fixed scroll to solve limitations with respect to sealing and friction reduction. That is, the back pressure chamber that communicates with a compression chamber having an intermediate pressure of a plurality of compression chambers formed between the orbiting scroll and the fixed scroll may be formed to allow the orbiting scroll and the fixed scroll to be adequately attached to each other, thereby solving the limitations with respect to leakage and lubrication.

The back pressure chamber may be formed on a bottom surface of the orbiting scroll or a top surface of the fixed scroll. For convenience of description, the back pressure chamber formed on the bottom surface of the orbiting scroll and the back pressure chamber formed on the top surface of the fixed scroll are referred to as a lower back pressure type scroll compressor and an upper back pressure type scroll compressor, respectively. The lower back pressure type scroll compressor has advantages in that the lower back pressure type scroll compressor has a simple structure, and a bypass hole is easily formed. However, as the back pressure chamber is formed on the bottom surface of the orbiting scroll that performs the orbiting motion, the back pressure chamber may change in configuration and position according to the orbiting motion. As a result, the orbiting scroll may be tilted, causing vibration and noise. In addition, an O-ring inserted to prevent the refrigerant from leaking may be quickly worn out. The upper back pressure type scroll compressor has a relatively complicated structure. However, as the back pressure chamber is fixed in configuration and position, the fixed scroll may not be tilted, and sealing of the back pressure chamber may be good.

Korean Patent Application No. 10-2000-0037517 (hereinafter the "prior document"), entitled Method for Processing Bearing Housing And Scroll Machine Having Bearing Housing, which is hereby incorporated by reference, discloses an example of the upper back pressure type scroll compressor. Referring to FIG. 1 of the prior document, a scroll compressor includes an orbiting scroll disposed on a main frame that is fixedly installed within a casing, and a fixed scroll engaged with the orbiting scroll. A back pressure chamber defined on the fixing scroll, and a floating plate to seal the back pressure chamber is disposed vertically slide along an outer circumference of a discharge passage. A cover is disposed on a top surface of the floating plate to partition an inner space of the scroll compressor into a suction space and a discharge space.

The back pressure chamber communicates with one of a plurality of compression chambers, and thus, an intermediate pressure is applied to the back pressure chamber. A pressure may be applied in an upward direction to the floating plate and in a downward direction to the fixed scroll. When the floating plate ascends due to the pressure of the back pressure chamber, an end of the floating plate may contact the cover to seal the discharge space. Also, the fixed scroll may move downward and then be closely attached to the orbiting scroll.

However, in a case of the upper back pressure type scroll compressor, when operation of the scroll compressor stops, an intermediate pressure refrigerant of the back pressure chamber may not be easily discharged toward the compression chambers and a suction-side by an orbiting scroll wrap. In detail, when the operation of the scroll compressor stops, the pressure within the scroll compressor may converge to a predetermined pressure (an equilibrium pressure). The equilibrium pressure may have a pressure value slightly higher than a suction-side pressure. That is, the refrigerant of the compression chamber and the discharge-side refrigerant may be discharged, and the inside of the compressor may converge to the equilibrium pressure. Then, when the scroll compressor operates again, the scroll compressor may operate while a difference between the equilibrium pressure and a pressure at each position may occur.

It may be necessary to maintain the equilibrium pressure within the back pressure chamber while the refrigerant of the back pressure chamber is discharged to the suction-side. If the refrigerant of the back pressure chamber is not discharged, the fixed scroll may be compressed downward by the pressure of the back pressure chamber, and thus, may be maintained in a state in which the fixed scroll is closely attached to the orbiting scroll. Also, if the refrigerant of the back pressure chamber is not discharged, the pressure of the back pressure chamber may be maintained at the equilibrium pressure. Accordingly, the floating plate may move upward to contact the cover. As a result, the discharge passage for the discharge-side refrigerant may be blocked, preventing the discharge-side refrigerant from being discharged to the suction-side of the compressor, thereby further compressing the fixed scroll downward.

As described above, when the fixed scroll is pressed to maintain the state in which the fixed scroll is closely attached to the orbiting scroll at a pressure greater than a predetermined pressure, it may be difficult to quickly drive the scroll compressor again. As a result, to quickly drive the scroll compressor again, a high initial torque of the scroll compressor may be required. When the initial torque increases, noise and abrasion may occur, reducing operation efficiency of the scroll compressor.

As described above, the refrigerant of the back pressure chamber has to be discharged toward the compression chamber and the suction-side when the operation of the scroll compressor stops. However, in the case of the upper back pressure type scroll compressor according to the related art, when the compressor operates and then stops, the revolving orbiting scroll wrap may be disposed at one position of the head plate of the fixed scroll. The orbiting scroll may stop in a state in which an end of the orbiting scroll blocks one point of the head plate that communicates with the back pressure chamber, that is, a discharge hole to discharge the intermediate pressure refrigerant into the back pressure chamber.

When the discharge hole is blocked by the wrap of the orbiting scroll, discharge of the refrigerant of the back pressure chamber into the compression chamber and the suction-side may be limited. As a result, quick re-operation of the compressor may be limited.

FIG. 1 illustrates a variation in pressure within a scroll compressor in a case in which discharge of the refrigerant of the back pressure chamber into the suction-side is restricted when the scroll compressor according to the related art stops. in FIG. 1, dotted line $P_1$ is a pressure of the refrigerant discharged from the compressor, solid line $P_2$ is an intermediate pressure of the refrigerant of the back pressure chamber, dotted line $P_3$ is a pressure of the cover-side refrigerant, and solid line $P_4$ is a pressure of the suction-side refrigerant.

Referring to FIG. 1, the scroll compressor according to the related art may stop at a time to after the scroll compressor operates. After the scroll compressor stops, the inside of the scroll compressor may converge to a predetermined pressure.

However, as the refrigerant of the back pressure chamber is not discharged to the compression chamber and the suction-side of the scroll compressor, maintenance of the inner pressure of the compressor to the equilibrium pressure may be limited. That is, the equilibration between the suction-side pressure $P_4$ and other pressures may be limited to cause a predetermined pressure difference $\Delta P$.

Also, after the scroll compressor stops, the scroll compressor may quickly re-operate even though the scroll compressor re-operates at a time $t_1$. That is, the pressure difference within the scroll compressor has to be quickly generated while the orbiting scroll revolves. However, the orbiting scroll may re-operate at a time $t_2$ after a predetermined time $t_1$ to $t_2$ has elapsed.

When the scroll compressor stops, the floating plate may quickly move downward due to the discharge pressure to discharge the cover-side refrigerant to the suction-side. For this, it may be necessary that a pressure in the discharge space is sufficiently larger than a pressure in the back pressure chamber. However, in the scroll compressor according to the related art, as the pressure of the discharge space is not sufficiently larger than the pressure of the back pressure chamber, the floating plate may not quickly move.

BRIEF DESCRIPTION OF THE DRAWINGS

Embodiments will be described in detail with reference to the following drawings in which like reference numerals refer to like elements, and wherein.

DETAILED DESCRIPTION

Figure 1:
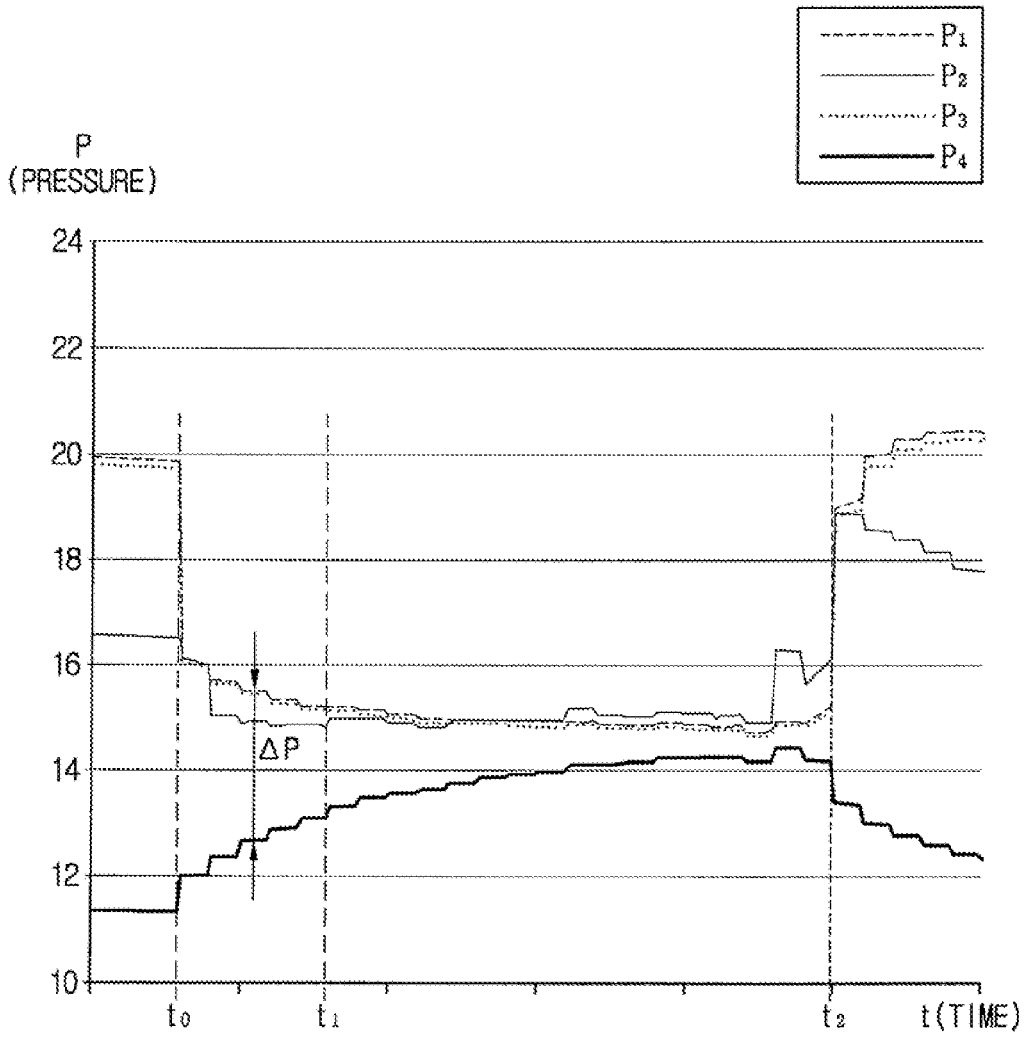
FIG. 1 is a graph illustrating a variation in inner pressure of a scroll compressor according to a related art when the scroll compressor stops and then re-operates.
Figure 2:
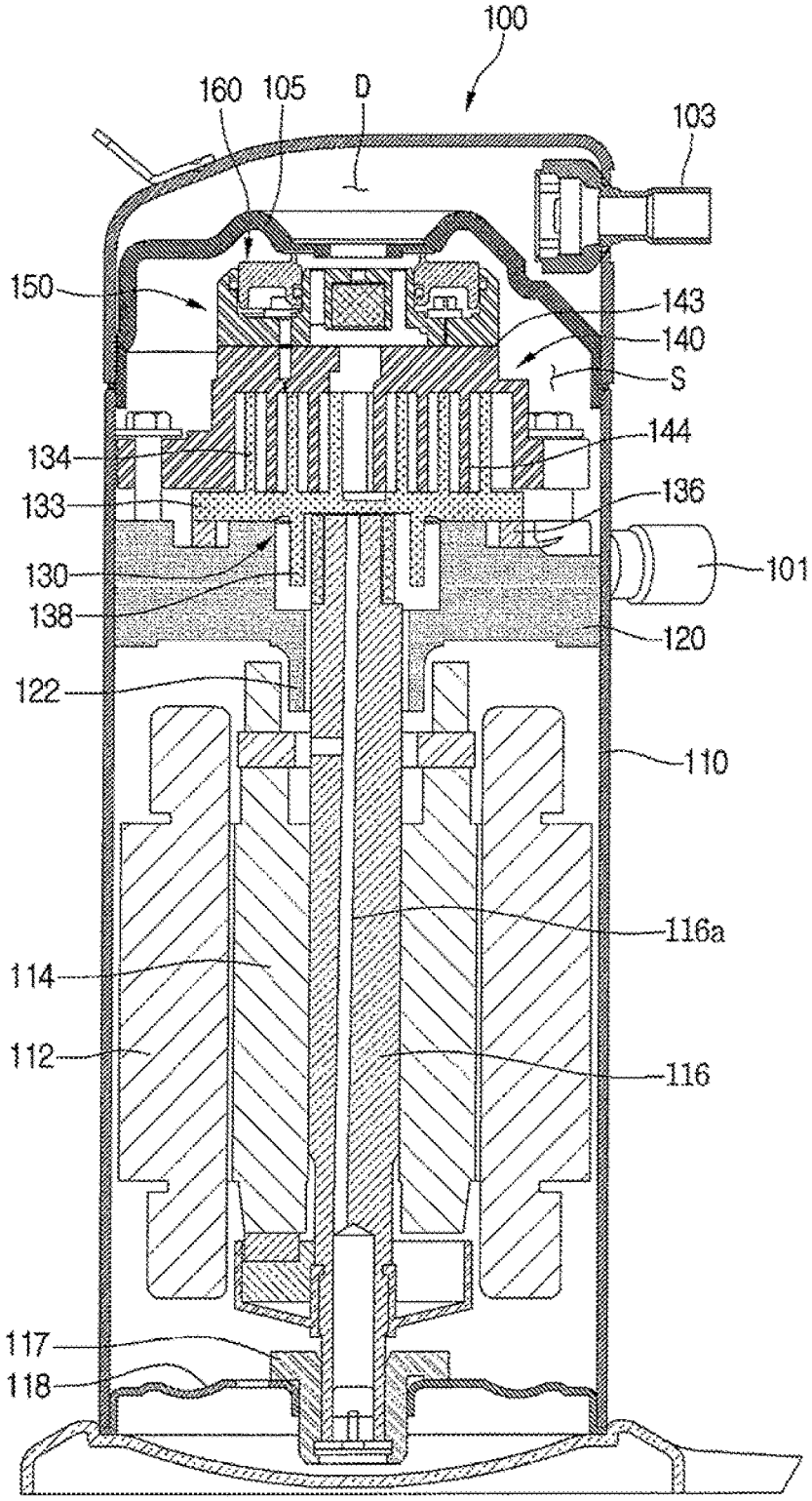
FIG. 2 is a cross-sectional view of a scroll compressor according to an embodiment.
Figure 3:
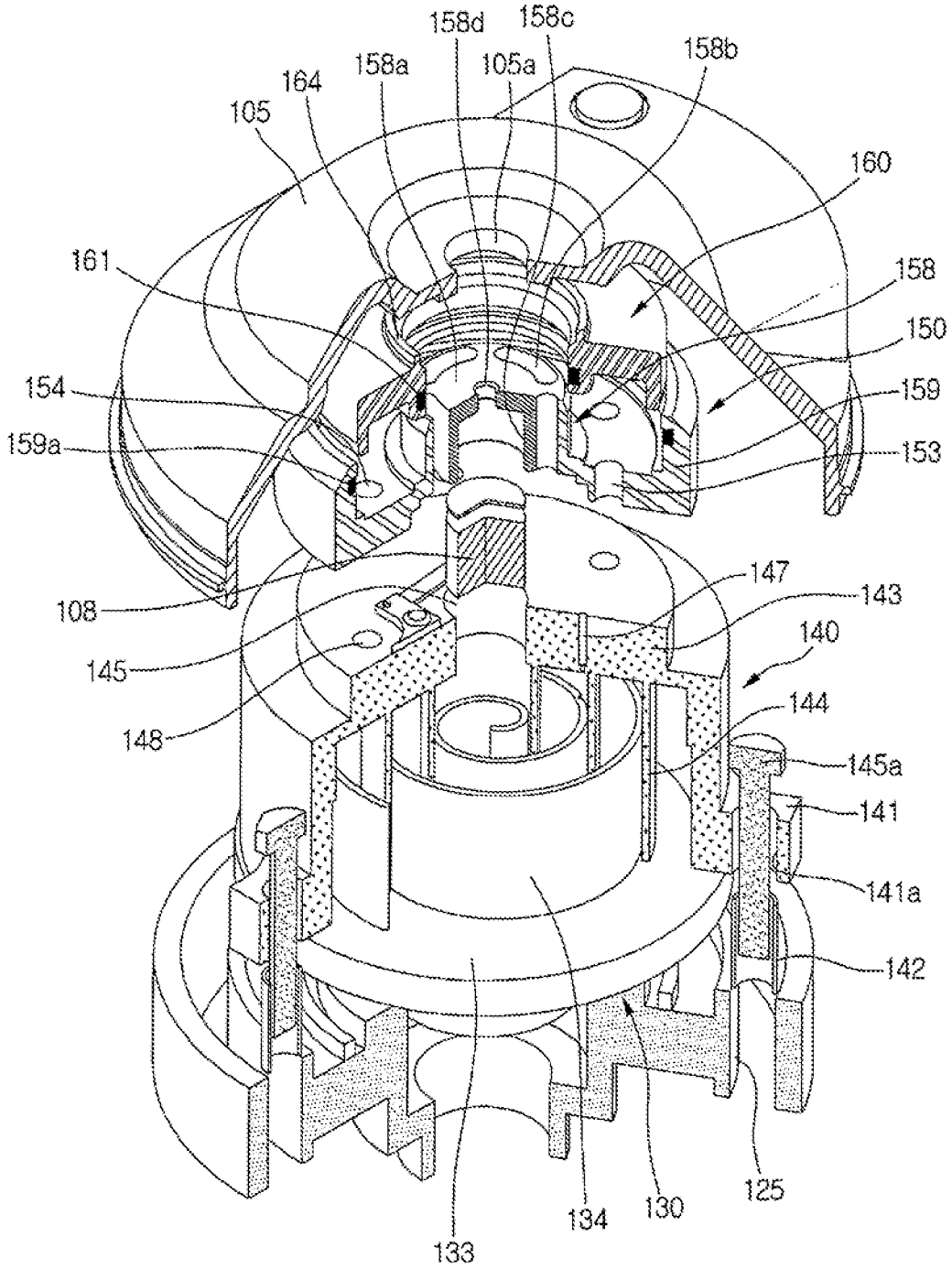
FIG. 3 is a partial exploded cross-sectional view of the scroll compressor of FIG. 2.
Figure 4:
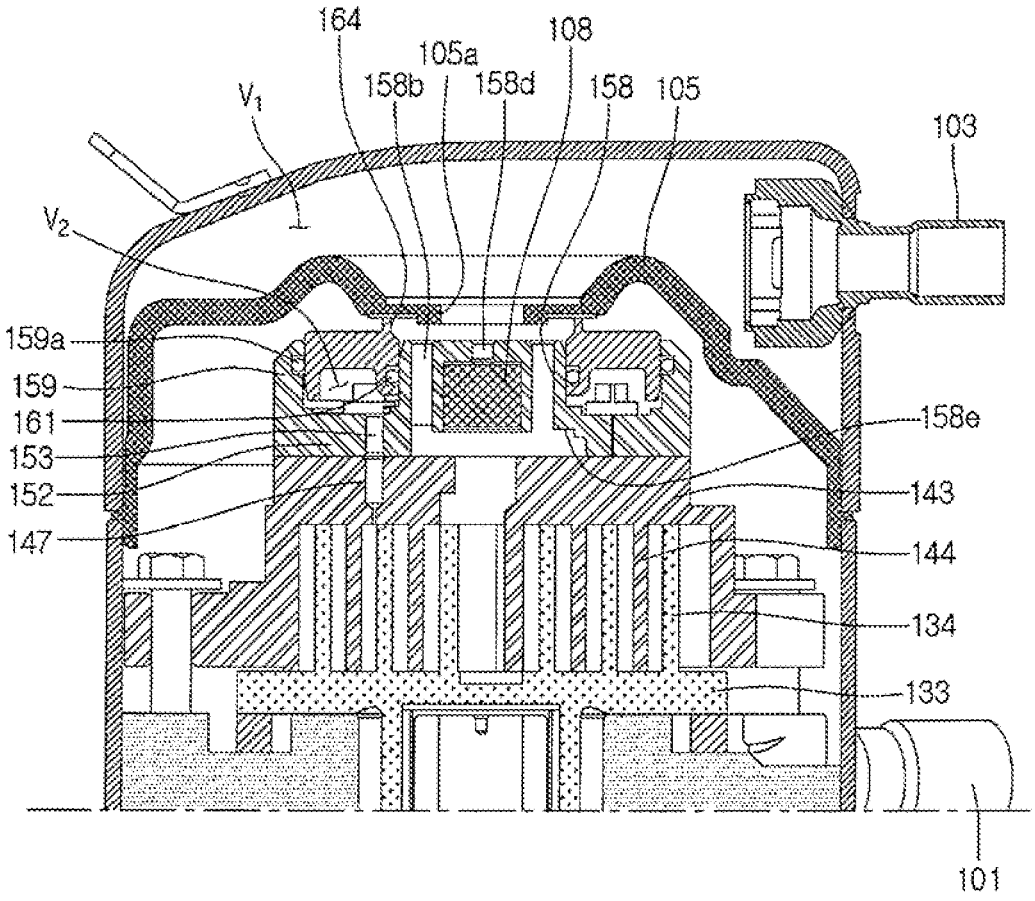
FIG. 4 is a partial cross-sectional view of the scroll compressor of FIG. 2.
Figure 5:
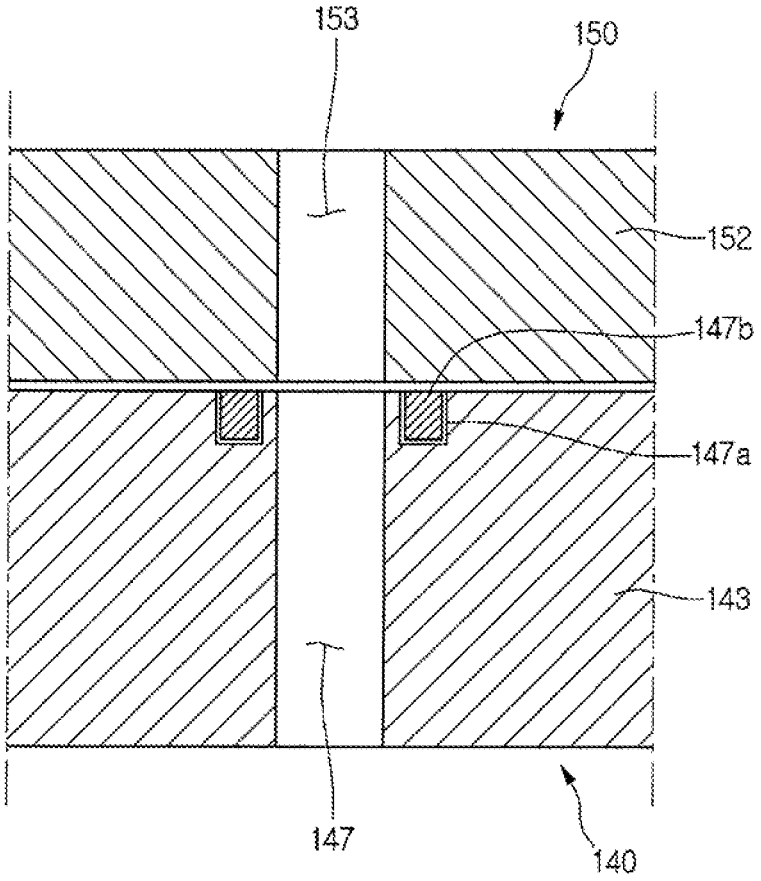
FIG. 5 is a partial enlarged cross-sectional view of a fixed scroll and a back pressure plate according to an embodiment.

FIG. 2 is a cross-sectional view of a scroll compressor according to an embodiment. FIG. 3 is a partial exploded cross-sectional view of the scroll compressor of FIG. 2. FIG. 4 is a partial cross-sectional view of the scroll compressor of FIG. 2. FIG. 5 is a partial enlarged cross-sectional view of a fixed scroll and a back pressure plate according to an embodiment.

Referring to FIGS. 2 to 5, a scroll compressor 100 according to an embodiment may include a casing 110 having a suction space S and a discharge space D. In detail, a cover 105 may be disposed in or at an inner upper portion of the casing 110. An inner space of the casing 110 may be partitioned into the suction space S and the discharge space D by the cover 105. An upper side of the cover 105 may correspond to the discharge space D, and a lower side of the cover 105 may correspond to the suction space S. A discharge hole 105*a*, through which a refrigerant compressed to a high pressure may be discharged, may be defined in an approximately central portion of the cover 105.

The scroll compressor 100 may further include a suction port 101 that communicates with the suction space S, and a discharge port 103 that communicates with the discharge space D. Each of the suction port 101 and the discharge port 103 may be fixed to the casing 101 to allow the refrigerant to be suctioned into the casing 110 or discharged outside of the casing 110.

A motor may be disposed at a lower portion of the suction space S. The motor may include a stator 112 coupled to an inner wall of the casing 110, a rotor 114 rotatably disposed within the stator 112, and a rotational shaft 116 that passes through a central portion of the stator 114.

A lower portion of the rotational shaft 116 may be rotatably supported by an auxiliary bearing 117 disposed on or at a lower portion of the casing 110. The auxiliary bearing 117 may be coupled to a lower frame 118 to stably support the rotational shaft 116.

The lower frame 118 may be fixed to the inner wall of the casing 110, and a bottom surface of the casing 110 may be used as an oil storage space. Oil stored in the oil storage space may be transferred upward by an oil supply passage 116*a* defined in the rotational shaft 116 and uniformly supplied into the casing 110. The oil supply passage 116*a* may be eccentrically disposed toward one side so that the oil introduced into the oil supply passage 116*a* may flow upward due to a centrifugal force generated by the rotation of the rotational shaft 116.

An upper portion of the rotational shaft 116 may be rotatably supported by a main frame 120. The main frame 120 may be fixed to the inner wall of the casing 110, like the lower frame 118. A main bearing 122 that protrudes in a downward direction may be disposed on a bottom surface of the main frame 120. The rotational shaft 116 may be inserted into the main bearing 122. An inner wall of the main bearing 122 may function as a bearing surface so that the rotational shaft 116 may smoothly rotate.

An orbiting scroll 130 may be disposed on a top surface of the main frame 120. The orbiting scroll 130 may include an orbiting head plate 133 having an approximately disk shape and disposed on the main frame 120, and an orbiting wrap 134 having a spiral shape and extending from the orbiting head plate 133. The orbiting head plate 133 may define a lower portion of the orbiting scroll 130 and function as a main body of the orbiting scroll 130, and the orbiting wrap 134 may extend upward from the orbiting head plate 133 to define an upper portion of the orbiting scroll 130. The orbiting wrap 134 together with a fixed wrap 144, which will be described hereinbelow, of a fixed scroll 140 may define a compression chamber. The orbiting scroll 130 may be referred to as a "first scroll", and the fixed scroll 140 may be referred to as a "second scroll".

The orbiting head plate 133 of the orbiting scroll 130 may revolve in a state, in which the orbiting head plate 133 is supported on the top surface of the main frame 120. An Oldham ring 136 may be disposed between the orbiting head plate 133 and the main frame 120 to prevent the orbiting scroll 130 from revolving. Also, a boss 138, into which the upper portion of the rotational shaft 116 may be inserted, may be disposed on a bottom surface of the orbiting head plate 133 of the orbiting scroll 130 to easily transmit a rotational force of the rotational shaft 116 to the orbiting scroll 130.

The fixed scroll 140 engaged with the orbiting scroll 130 may be disposed on the orbiting scroll 130. The orbiting scroll 130 may include a plurality of pin supports 141 that protrudes from an outer circumferential surface of the orbiting scroll 130 and each of which may have a guide hole 141*a*, a guide pin 142 inserted into the guide hole 141*a* and disposed on the top surface of the main frame 120, and a coupling member 145*a* inserted into the guide pin 142 and fitted into an insertion hole 125 of the main frame 120.

The fixed scroll 140 may include a fixed head plate 143 having a disk shape, and a fixed wrap 144 that extends from the fixed head plate 143 toward the orbiting head plate 133 and engaged with the orbiting wrap 134 of the orbiting scroll 130. The fixed head plate 143 may define an upper portion of the fixed scroll 140 and function as a main body of the fixed scroll 140, and the fixed wrap 144 may extend downward from the fixed head plate 143 to define a lower portion of the fixed scroll 140. For convenience of description, the orbiting head plate 133 may be referred to as a "first head plate" and the fixed head plate 143 may be referred to as a "second head plate". Further, the orbiting wrap 134 may be referred to as a "first wrap", and the fixed wrap 144 may be referred to as a "second wrap".

An end of the fixed wrap 144 may be disposed to contact the orbiting head plate 133, and an end of the orbiting wrap 134 may be disposed to contact the fixed head plate 143. The fixed wrap 144 may extend in a predetermined spiral shape, and a discharge hole 145, through which the compressed refrigerant may be discharged, may defined in an approximately central portion of the fixed head plate 143. A suction hole (not shown), through which the refrigerant within the suction space S may be suctioned, may be defined in a side surface of the fixed scroll 140. The refrigerant suctioned through the suction hole may be introduced into the compression chamber defined by the orbiting wrap 134 and the fixed wrap 144.

In detail, the fixed wrap 144 and the orbiting wrap 134 may define a plurality of compression chambers. Each of the compression chambers may be reduced in volume while revolving and moving to the discharge hole-side to compress the refrigerant. Thus, the compression chamber adjacent to the suction hole may be minimized in pressure, and the compression chamber that communicates with the discharge hole 145 may be maximized in pressure. Also, the compression chamber between the above-described compression chambers may have an intermediate pressure that corresponds to a pressure between a suction pressure of the suction hole and a discharge pressure of the discharge hole 145. The intermediate pressure may be applied to a back pressure chamber BP, which will be described hereinbelow, to press the fixed scroll 140 toward the orbiting scroll 130.

An intermediate pressure discharge hole 147 that transfers the refrigerant of the compression chamber having the intermediate pressure to the back pressure chamber BP may be defined in the fixed head plate 143 of the fixed scroll 140. That is, the intermediate pressure discharge hole 147 may be defined in a portion of the fixed scroll 130 at which the pressure in the compression chamber that communicates with the intermediate pressure discharge hole 147 is greater than a pressure in the suction space S and less than a pressure in the discharge space D. The intermediate pressure discharge hole 147 may pass from a top surface to a bottom surface of the fixed head plate 143.

A back pressure chamber assembly 150 and 160 that defines the back pressure chamber may be disposed on or at a side of the fixed scroll 140. The back pressure chamber assembly 150 and 160 may include a back pressure plate 150, and a floating plate 160 separably coupled to the back pressure plate 150 and may be disposed on the upper portion of the fixed head plate 143 of the fixed scroll 140.

The back pressure plate 150 may include a support 152 having an approximately annular shape with a hollow and may contact the fixed head plate 143 of the fixed scroll 140. An intermediate pressure suction hole 153 that communicates with the intermediate pressure discharge hole 147 may be defined in the support 152. The intermediate pressure suction hole 153 may pass from a top surface to a bottom surface of the support 152.

As illustrated in FIG. 5, the intermediate pressure discharge hole 147 of the fixed scroll 140 and the intermediate pressure suction hole 153 of the back pressure part 150 may be disposed to be aligned with each other. The refrigerant discharged from the intermediate pressure discharge hole 147 may be introduced into the back pressure chamber BP via the intermediate pressure suction hole 153. The intermediate pressure discharge hole 147 and the intermediate pressure suction hole 153 may be referred to as a "bypass passage" in that the refrigerant of the back pressure chamber BP may be bypassed to the compression chamber through the intermediate pressure discharge hole 147 and the intermediate pressure suction hole 153.

The fixed scroll 140 may include an intermediate pressure O-ring 147*b* disposed around the intermediate pressure discharge hole 147 to prevent the refrigerant discharged from the intermediate pressure discharge hole 147 from leaking. The intermediate pressure O-ring 147*b* may be disposed in the intermediate pressure sealing groove 147*a* of the fixed head plate 143.

A second coupling hole 154 that communicates with a first coupling hole 148 defined in the fixed head plate 143 of the fixed scroll 140 may be defined in the support 152. The first coupling hole 148 and the second coupling hole 154 may be coupled to each other by a predetermined coupling member.

The back pressure plate 150 may include a plurality of walls 158 and 159 that extend in an upward direction from the support 152. The plurality of walls 158 and 159 may include a first wall 158 that extends in the upward direction from an inner circumferential surface of the support 152, and a second wall 159 that extends in the upward direction from an outer circumferential surface of the support 152. Each of the first and second walls 158 and 159 may have an approximately cylindrical shape.

The first and second walls 158 and 159 together with the support 152 may define a space having a predetermined shape. The space may define the above-described back pressure chamber BP.

A third wall 158*c* that accommodates a switching device 108 may be disposed in the first wall 158. The third wall 158*c* may have a cylindrical shape with a hollow and may be disposed to be spaced apart inward from the first wall 158.

The back pressure portion 150 may include a top surface 158*a* disposed on an upper portion of the third wall 158*c*. The top surface 158*a* may be coupled to an inner circumferential surface of the first wall 158 to serve as a "stopper" to restrict upward movement of the switching device 108.

The intermediate discharge hole 158*b* that communicates with the discharge hole 145 of the fixed head plate 143 to discharge the refrigerant discharged from the discharge hole 145 toward the cover 105 may be disposed between the inner circumferential surface of the first wall 158 and an outer circumferential surface of the third wall 158*c*. The intermediate discharge hole 158*b* may extend from a lower portion to an upper portion of the first wall 158. A plurality of the intermediate discharge hole 158*b* may be provided. As the intermediate discharge hole 158*b* is provided, a space defined between the first wall 158 having the cylindrical shape and the third wall 158*c* disposed inside the first wall 158 may communicate with the discharge hole 145 to define at least a portion of a discharge passage through which the discharged refrigerant may flow toward the discharge space D.

The switching device 108 having an approximately circular pillar shape may be disposed inside the third wall 158*c*. The third wall 158*c* may be disposed to accommodate at least a portion of the switching device 108, and the top surface 158*a* may be disposed to cover an upper side of the switching device 108.

The switching device 108 may be disposed above the discharge hole 145 and may have a size sufficient to completely cover the discharge hole 145. Thus, when the switching device 108 moves downward to contact the fixed head plate 143 of the fixed scroll 140, the switching device 108 may close the discharge hole 145 (see FIG. 11). The third wall 158*c* may be referred to as a "moving guide" in that the third wall 230 guides movement of the switching device 108. The switching device 108 may be movable upward or downward according to a variation in pressure applied to the switching device 108.

A discharge pressure apply hole 158*d* may be defined in the top surface 158*a* of the first wall 158. The discharge pressure apply hole 158*d* may communicate with the discharge hole 145. The discharge pressure apply hole 158*d* may be defined in an approximately central portion of the top surface 158*a*, and the plurality of intermediate discharge holes 158*b* may be disposed to surround the discharge pressure apply hole 158*d*.

For example, when the scroll compressor 100 stops, a pressure within the compression chamber may be relatively lowered. Thus, the refrigerant may flow backward from the discharge space D to the discharge hole 145. In this case, the pressure applied to the discharge pressure apply hole 158 may be greater than the pressure of the discharge hole 145. Thus, a pressure may be applied downward on a top surface of the switching device 108. As a result, the switching device 108 may be spaced apart from the top surface 158*a* to move downward, thereby closing the discharge hole 145.

On the other hand, when the scroll compressor 100 operates to compress the refrigerant in the compression chamber, a pressure of the discharge hole 145 through which the compressed refrigerant may be discharged may be greater than the pressure within the discharge space D. In this case, an upward pressure may be applied to a bottom surface of the switching device 108. Thus, the switching device 108 may open the discharge hole 145 while moving upward and then move to a position adjacent to the top surface 158*a*, for example, a position that contacts the top surface 158*a*.

The switching device 108 may move upward up to a position that is adjacent to a bottom surface of the top surface 158*a*. For example, the switching device 108 may move upward until the switching device 108 contacts the bottom surface of the top surface 158*a*. When the discharge hole 145 is opened, the refrigerant discharged from the discharge hole 145 may flow toward the cover 105 via the intermediate discharge hole 158*b*, and then, may be discharged outside of the compressor 100 through the discharge port 103 via the discharge hole 105*a*.

The back pressure plate 150 may include a step 158*e* disposed inside a portion at which the first wall 158 and the support 152 are connected to each other. The refrigerant discharged from the discharge hole 145 may reach a space defined by the step 158*e*, and then, may flow to the intermediate discharge hole 158*b*.

The second wall 159 may be spaced a predetermined distance from the first wall 158 to surround the first wall 158. The back pressure plate 150 may have a space having an approximately U-shaped cross-section formed by the first wall 158, the second wall 159, and the support 152. The floating plate 160 may be disposed in the space. The space, which may be covered by the floating plate 160, may define the back pressure chamber BP. On the other hand, the first and second walls 158 and 159 of the back pressure plate 150, the support 152, and the floating plate 160 may define the back pressure chamber BP. The cover 105 may be disposed above the floating plate 160.

The floating plate 160 may have an annular plate shape and include an inner circumferential surface that faces an outer circumferential surface of the first wall 158 and an outer circumferential surface that faces an inner circumferential surface of the second wall 159. That is, the inner circumferential surface of the floating plate 160 may be disposed to contact the outer circumferential surface of the first wall 158, and the outer circumferential surface of the floating plate 160 may be disposed to contact the inner circumferential surface of the second wall 159.

O-rings 159*a* and 161 may be disposed on or at contact portions between the floating plate 160 and the first and second walls 158 and 159, respectively. The O-rings 159*a* and 161 may include a first O-ring 159*a* disposed on or at the contact portion between the inner circumferential surface of the second wall 159 and the outer circumferential surface of the floating plate 160, and a second O-ring 161 disposed on or at the contact portion between the outer circumferential surface of the first wall 158 and the inner circumferential surface of the floating plate 160. For example, the first O-ring 159*a* may be disposed on the inner circumferential surface of the second wall 159, and the second O-ring 161 may be disposed on the inner circumferential surface of the floating plate 160. Leakage through contact surfaces between the first and second walls 158 and 159 and the floating plate 160, that is, refrigerant leakage from the back pressure chamber BP may be prevented by the O-rings 159*a* and 161.

A rib 164 that extends in an upward direction may be disposed on a top surface of the floating plate 160. For example, the rib 164 may extend in the upward direction from the inner circumferential surface of the floating plate 160.

The rib 164 may be movably disposed to selectively contact a bottom surface of the cover 105. When the rib 164 contacts the cover 105, the suction space S and the discharge space D may be partitioned. On the other hand, when the rib 164 is spaced from the bottom surface of the cover 105, that is, when the rib 164 moves in a direction away from the cover 105, the suction space S and the discharge space D may communicate with each other.

In detail, while the scroll compressor 100 operates, the floating plate 160 may move upward to allow the rib 164 to contact the bottom surface of the cover 105. Thus, the rib 164 may serve as a sealing member so that the refrigerant discharged from the discharge hole 145 to pass through the intermediate discharge hole 158*b* does not leak into the suction space S, but rather, may be discharged into the discharge space D.

On the other hand, when the scroll compressor 100 stops, the floating plate 160 may move downward to allow the rib 164 to be spaced apart from the bottom surface of the cover 105. Thus, the discharged refrigerant disposed at the cover-side may flow toward the suction space S through the space between the rib 164 and the cover 105.

To quickly press the floating plate 160 using the discharged refrigerant disposed at a side of the cover 105, a pressure of the discharged refrigerant disposed at the side of the cover 105 may be sufficiently larger than the pressure of the back pressure chamber BP. In this embodiment, a volume V1 of the discharge space D may be greater by a set or predetermined ratio or more than a volume V2 of the back pressure chamber BP. The volume V1 may be a volume of an upper space of the cover 105, that is, a volume of a space defined between the cover 105 and the casing 110. As described above, the volume V2 may be a volume of a space between the back pressure plate 150 and the floating plate 160, that is, a volume of an inner space, which is covered by the floating plate 160, of the space defined by the first wall 158, the second wall 159, and the support 152.

For example, the volume V1 may be greater by about 20 times or more than the volume V2. The related effects will be described with reference to FIGS. 14A to 14D.

When the compressor stops, the floating plate 160 may quickly move downward due to the ratio of the volume V1 to the volume V2. Thus, the discharge-side refrigerant and the refrigerant of the back pressure chamber may be easily discharged toward the suction space S. Thus, the pressure within the scroll compressor may converge to the equilibrium pressure, and then, the compressor may quickly re-operate.

Figure 6:
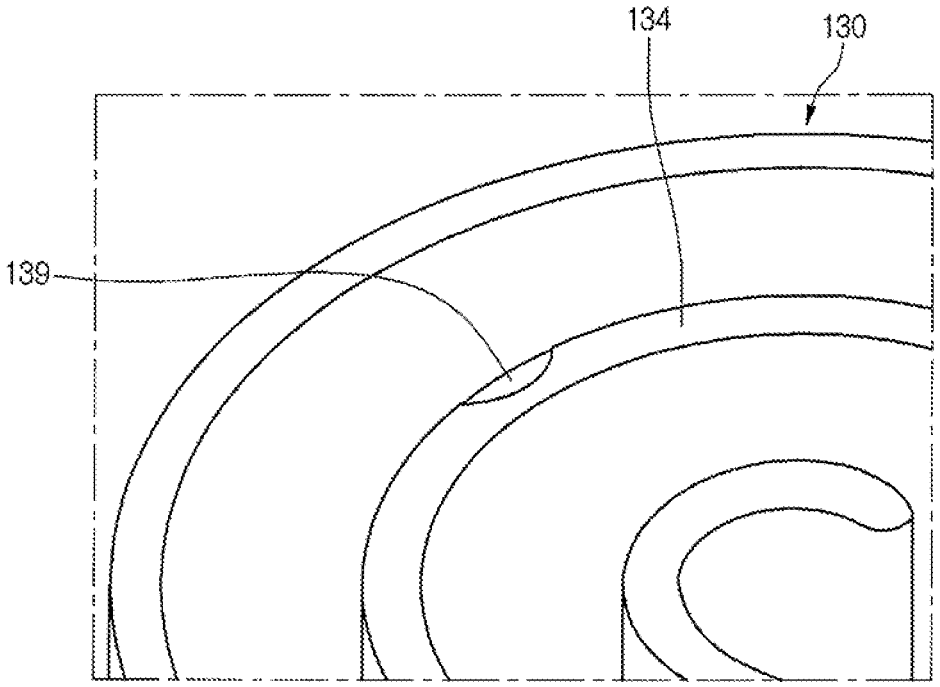
FIG. 6 is a view illustrating a portion of an orbiting scroll according to an embodiment.
Figure 7:
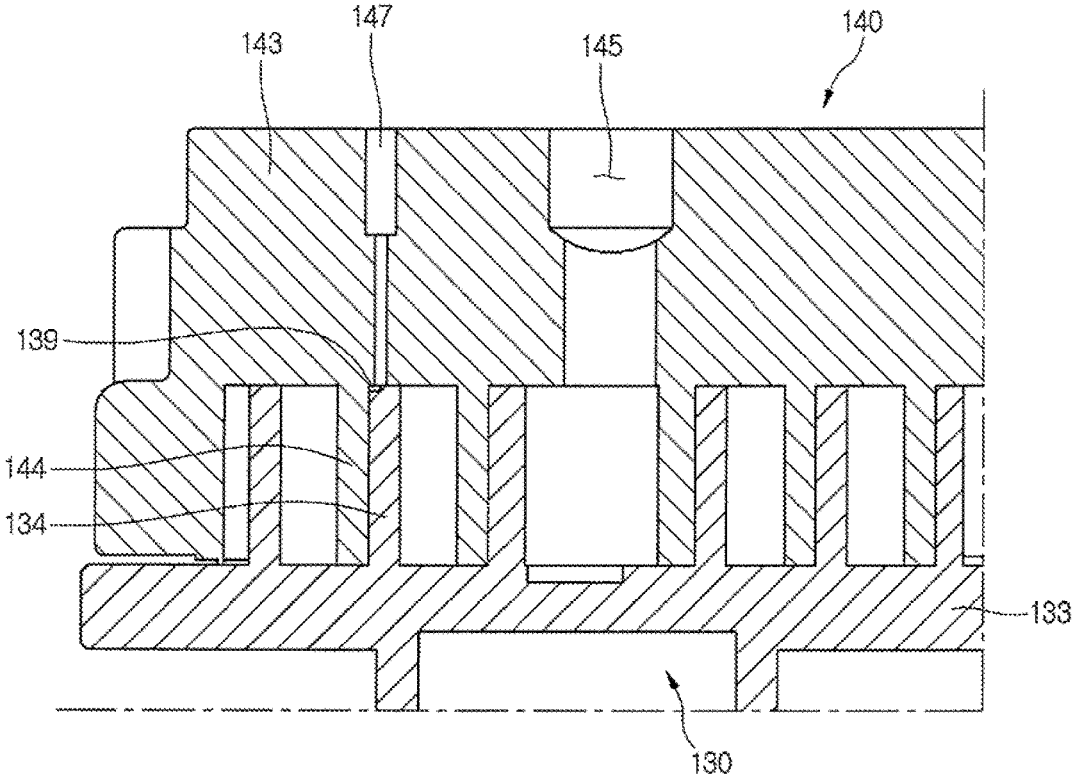
FIG. 7 is a cross-sectional view illustrating a coupled state of the fixed scroll and the orbiting scroll according to an embodiment.
Figure 8A:
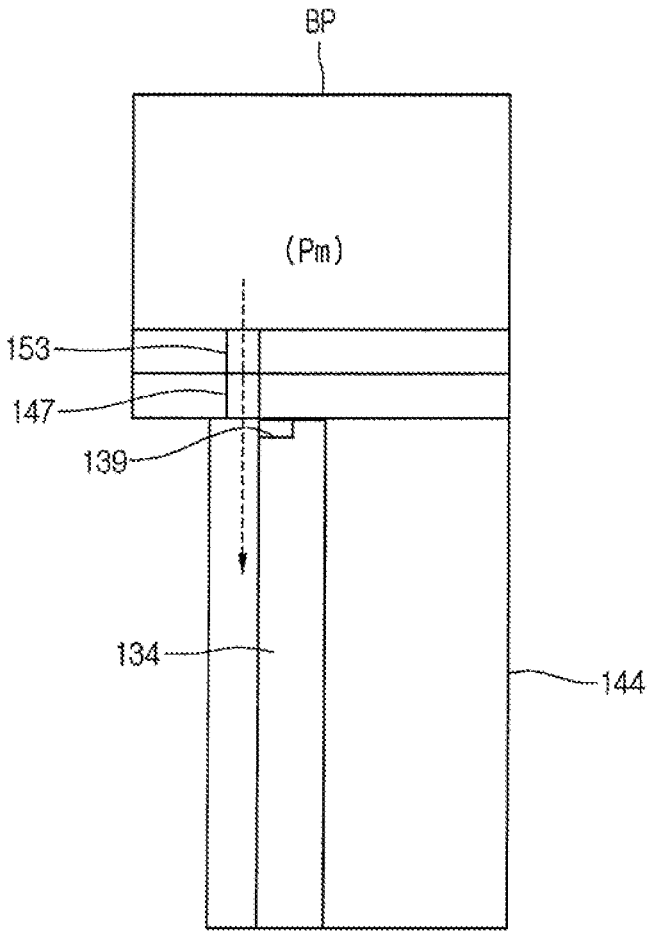
FIGS. 8A and 8B are schematic views illustrating a state in which an intermediate pressure refrigerant of a back pressure chamber is discharged into a compression chamber through a discharge guide according to a position of the orbiting scroll.
Figure 8B:
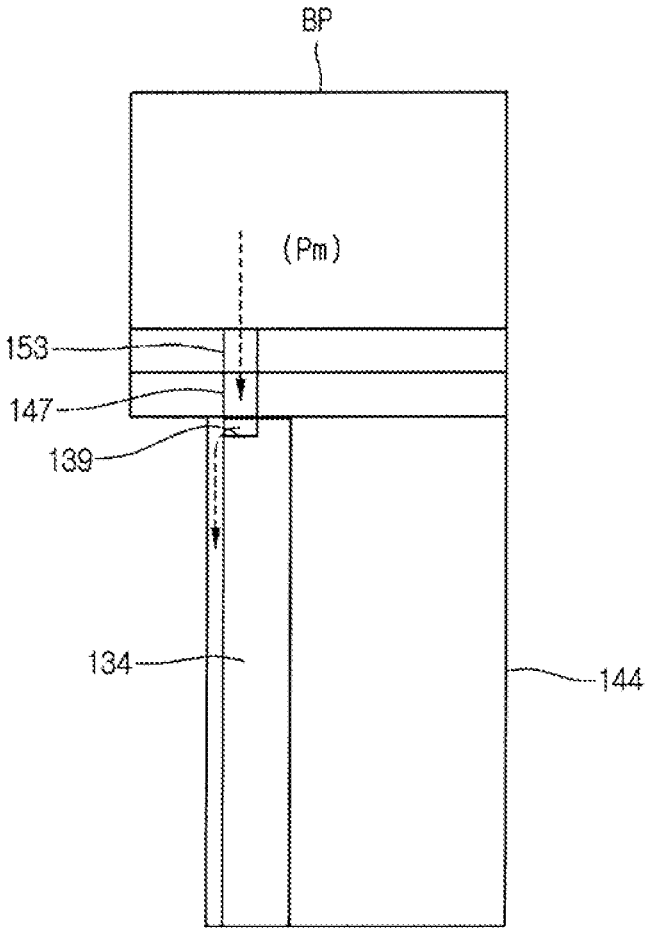

FIG. 6 is a view illustrating a portion of an orbiting scroll according to an embodiment. FIG. 7 is a cross-sectional view illustrating a coupled state of the fixed scroll and the orbiting scroll according to an embodiment. FIGS. 8A and 8B are schematic views illustrating a state in which an intermediate pressure refrigerant of a back pressure chamber is discharged into the compression chamber through a discharge guide according to a position of the orbiting scroll.

Referring to FIGS. 6 and 7, the orbiting scroll 130 according to an embodiment may include a discharge guide 139 to guide the refrigerant flowing into the intermediate pressure discharge hole 147 so that the refrigerant is introduced into a space (region) having a pressure less than the pressure of the back pressure chamber BP. In detail, when operation of the scroll compressor 100 stops, the compression chamber defined by the orbiting wrap 134 and the fixed wrap 144 vanishes, and thus, the refrigerant may flow into the space (region) between the orbiting wrap 134 and the fixed wrap 144. The space (region) may have a pressure less than the pressure of the back pressure chamber BP. The space (region) may be referred to as a "wrap space".

The discharge guide 139 may be recessed from an end surface of the orbiting wrap 134 of the orbiting scroll 130. Thus, the discharge guide 139 may be referred to as a "recess". The end surface of the orbiting wrap 134 may be understood as a surface of the orbiting wrap 134 that faces the fixed head plate 143 of the fixed scroll 140 or a surface of the orbiting wrap 134 that contacts the fixed head plate 143.

A width of the end surface of the orbiting wrap 134, that is, a thickness of the orbiting wrap 134 may be greater than a width of the intermediate pressure discharge hole 147. Also, the discharge guide 139 may be recessed from the end surface of the orbiting wrap 134 by a preset or predetermined width and depth, which will be discussed hereinbelow.

While the orbiting scroll 130 revolves, the orbiting wrap 134 may be disposed directly below the intermediate pressure discharge hole 147 or be disposed to be spaced from a lower end of the intermediate pressure discharge hole 147 in a transverse or radial direction to open the intermediate pressure discharge hole 147. The term "transverse direction" or "radial direction" may referred to as a vertical direction in which the rotational shaft 116 extends.

If the discharge guide 139 is not provided, when the orbiting wrap 134 is disposed directly below the intermediate pressure discharge hole 147 (in FIG. 7), the orbiting wrap 134 may cover the intermediate pressure discharge hole 147. On the other hand, when the orbiting wrap 134 moves horizontally by a predetermined distance, at least a portion of the intermediate pressure discharge hole 147 may be opened.

Also, while the scroll compressor 100 operates, when the intermediate pressure discharge hole 147 is opened, the intermediate pressure refrigerant of the compression chamber may be introduced into the back pressure chamber BP through the intermediate pressure discharge hole 147. On the other hand, in a state in which the scroll compressor 100 stops, when the orbiting wrap 134 is disposed directly below the intermediate pressure discharge hole 147 to block the intermediate pressure discharge hole 147, the refrigerant of the back pressure chamber BP may not be introduced into the wrap space through the intermediate pressure discharge hole 147. As a result, the equilibrium pressure may not be maintained, and thus, quick re-operation of the second compressor may be limited.

Thus, embodiments herein disclosed may have a feature in which the discharge guide 139 is disposed in the orbiting wrap 134 to prevent the intermediate pressure discharge hole 147 from being completely covered or shielded, and thus, even though the orbiting wrap 134 is disposed directly below the intermediate pressure discharge hole 147, the intermediate pressure discharge hole 147 and the compression chamber (when the compressor operates) or the intermediate pressure discharge hole 147 and the wrap space (when the compressor stops) may communicate with each other. The back pressure chamber BP and the intermediate pressure discharge hole 147 may always communicate with the compression chamber by the discharge guide 139. That is, the discharge guide 139 may be disposed on an end of the orbiting wrap 134 at a position at which the back pressure chamber BP and the intermediate pressure discharge hole 147 always communicate with the compression chamber.

In summary, even though the orbiting wrap 134 is disposed directly below the intermediate pressure discharge hole 147 while the orbiting wrap 134 revolves, the lower end of the intermediate pressure discharge hole 147 and the end surface of the orbiting wrap 134 may be spaced apart from each other by the recessed discharge guide 139. Thus, when the compressor operates, the refrigerant of the compression chamber may be introduced into the back pressure chamber BP through the intermediate pressure discharge hole 147. Also, when the compressor stops, the refrigerant of the back pressure chamber BP may be introduced into the wrap space through the intermediate pressure discharge hole 147.

FIG. 8B illustrates a state in which the orbiting wrap 134 is disposed directly below the intermediate pressure discharge hole 147 while the orbiting wrap 134 revolves, that is, a state in which the end surface of the orbiting wrap 134 is disposed to block the intermediate pressure discharge hole 147 if the discharge guide 139 is not provided. Even though the orbiting wrap 134 is disposed as illustrated in FIG. 88B, the intermediate pressure discharge hole 147 may communicate with the compression chamber through the discharge guide 139. Thus, when the compressor stops, the refrigerant of the back pressure chamber BP having an intermediate pressure Pm may be introduced into the wrap space between the orbiting wrap 134 and the fixed wrap 144 via the intermediate pressure discharge hole 147 and the discharge guide 139.

If the orbiting wrap 134 is disposed as illustrated in FIG. 8A, at least a portion of the intermediate pressure discharge hole 147 is opened. That is, the orbiting wrap 134 may be in a state in which the orbiting wrap 134 moves horizontally to open the at least a portion of a lower end of the intermediate pressure discharge hole 147. Thus, when the compressor stops, as the intermediate pressure discharge hole 147 is opened, the refrigerant of the back pressure chamber BP having the intermediate pressure Pm may be introduced into the wrap space through the intermediate pressure discharge hole 147.

Figure 9:
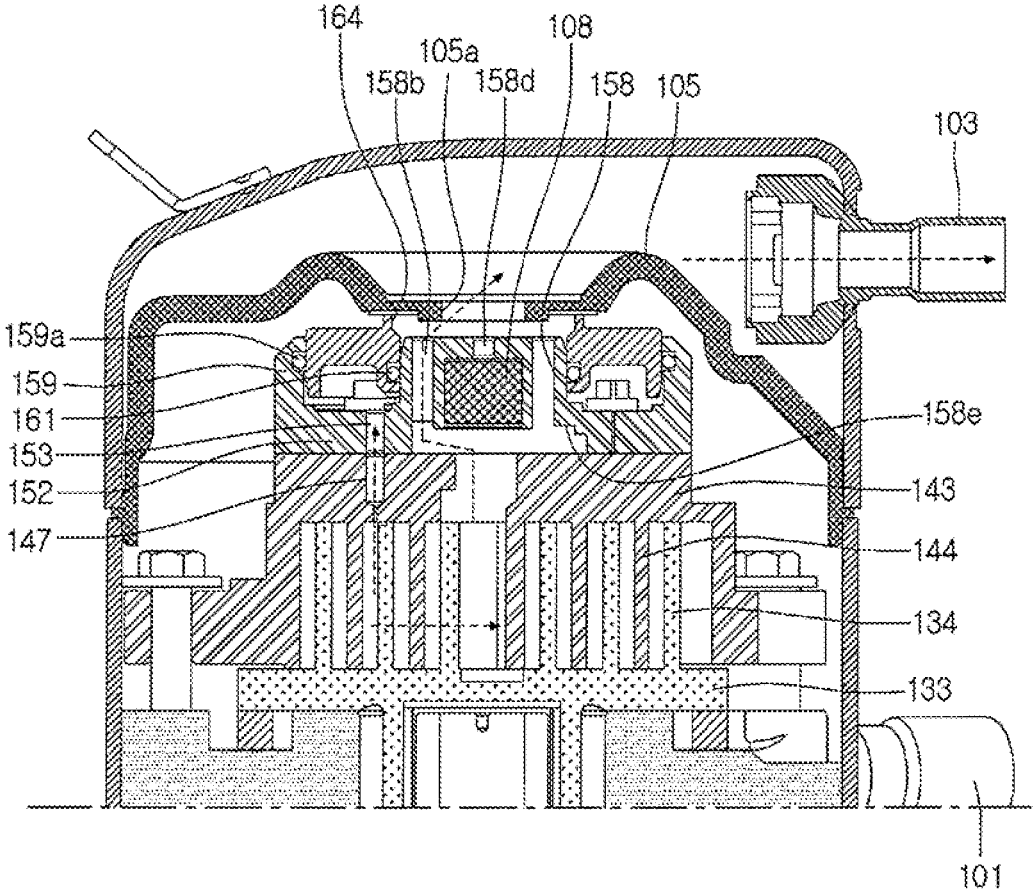
FIG. 9 is a cross-sectional view illustrating a flow of the refrigerant while the scroll compressor according to an embodiment operates.
Figure 10:
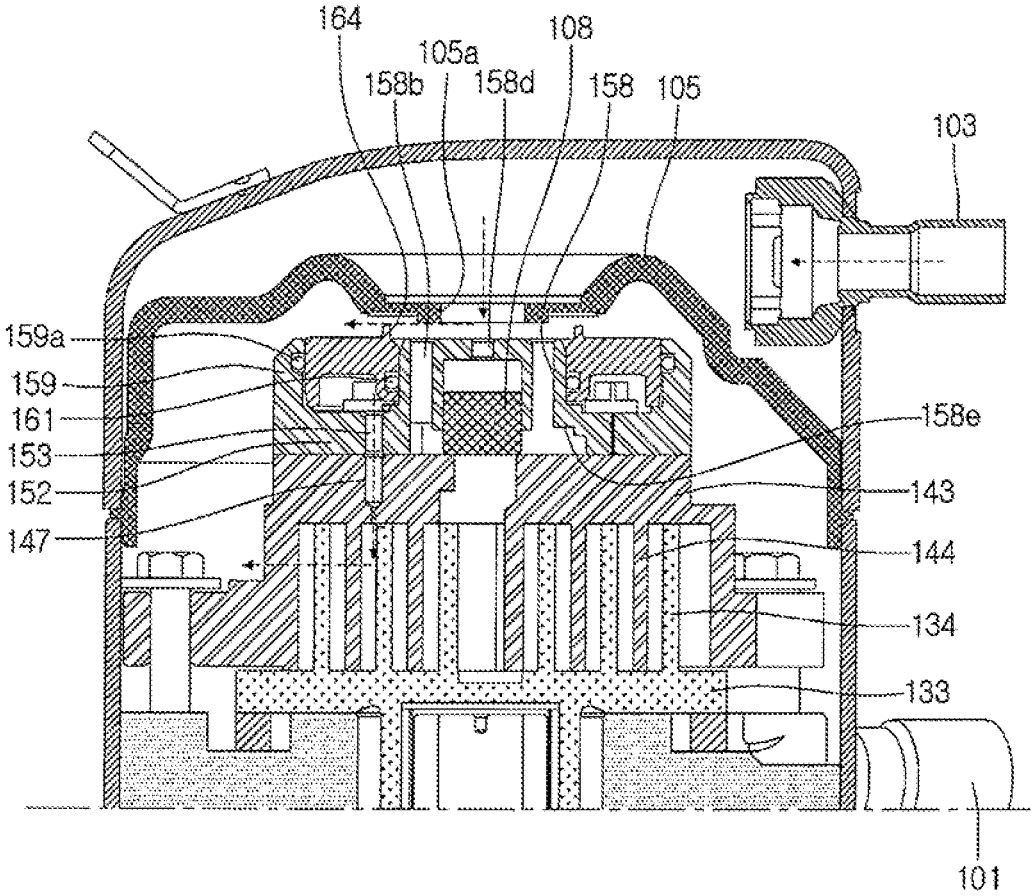
FIG. 10 is a cross-sectional view illustrating a flow of the refrigerant when the scroll compressor according to an embodiment stops.

FIG. 9 is a cross-sectional view illustrating a flow of the refrigerant when the scroll compressor according to an embodiment operates. FIG. 10 is a cross-sectional view illustrating a flow of the refrigerant when the scroll compressor according to an embodiment stops.

Referring to FIGS. 9 and 10, when the scroll compressor operates or stops, effects according to this embodiment, that is, a flow of the refrigerant will be described.

Referring to FIG. 9, in a case, in which the scroll compressor 100 according to an embodiment operates, when power is applied to the stator 112, the rotational shaft 116 is rotated by the stator 112 and the rotor 114. Also, as the rotational shaft 116 rotates, the orbiting scroll 130 coupled to the rotational shaft 116 revolves with respect to the fixed scroll 140. As a result, the plurality of compression chambers formed between the fixed wrap 144 and the orbiting wrap 134 may move toward the discharge hole 145 to compress the refrigerant.

The fixed wrap 144 and the orbiting wrap 134 may be closely attached to each other in a radial direction, that is, a direction perpendicular to the rotational shaft 116 to form the plurality of compression chambers. The plurality of compression chambers may be sealed by the closely attached operations of the wraps 134 and 144 to prevent the refrigerant from leaking radially.

While the refrigerant is compressed, at least a portion of the refrigerant within the compression chamber having the intermediate pressure may be introduced into the back pressure chamber BP through the intermediate pressure discharge hole 147 of the fixed scroll 140 and the intermediate pressure suction hole 153 of the back pressure plate 150. Even though the orbiting wrap 134 of the orbiting scroll 130 is disposed directly below the intermediate pressure discharge hole 147 to contact the intermediate pressure discharge hole 147, as the intermediate pressure discharge hole 147 and the compression chamber communicate with each other by the discharge guide 139, the refrigerant may flow into the intermediate pressure discharge hole 147. Also, as the intermediate pressure discharge hole 147 and the back pressure chamber BP communicate with each other, the refrigerant flowing through the intermediate pressure discharge hole 147 may be easily introduced into the back pressure chamber BP.

Thus, the back pressure chamber BP may have the intermediate pressure that corresponds to a pressure between the suction pressure and the discharge pressure. As described above, as the back pressure chamber BP has the intermediate pressure, a downward force may be applied to the back pressure plate 150, and an upward force may be applied to the floating plate 160.

As the back pressure plate 150 is coupled to the fixed scroll 140, the intermediate pressure of the back pressure chamber BP may have an influence on the fixed scroll 140. Thus, the orbiting wrap 144 of the fixed scroll 140 may be closely attached to the orbiting head plate 133 of the orbiting scroll 130, and the floating plate 160 may move upward.

The fixed wrap 144 and orbiting head plate 133, and the orbiting wrap 134 and fixed head plate 143 may be closely attached to each other in an axial direction, that is, a direction parallel to the rotational shaft 116 to form the plurality of compression chambers. The plurality of compression chambers may be sealed by adhesion between the wraps 134 and 144 and the orbiting and fixed head plates 133 and 143 to prevent the refrigerant from leaking in the axial direction.

As the floating plate 160 moves upward, the rib 164 of the floating plate 160 may move upward until the rib 164 contacts the bottom surface of the cover 105. While the refrigerant is pressed, the refrigerant of the compression chamber moving toward the discharge hole 145 may flow toward the intermediate discharge hole 158*b* of the back pressure plate 150 through the discharge hole 145, and then may be discharged from the discharge port 103 outside of the scroll compressor via the discharge hole 105*a* of the cover 105.

The switching device 108 may be in a state in which the switching device 108 is moved upward along the moving guide 158*c* by the refrigerant having the discharge pressure, which is discharged from the discharge hole 145. Thus, the discharge hole 145 may be opened. That is, as the pressure of the discharge hole 145 is greater than the pressure of the discharge space D, the switching device 108 may move upward. As described above, as the rib 164 contacts the bottom surface of the cover 105 to block the passage between the floating plate 160 and the cover 105, the refrigerant passing through the intermediate discharge hole 158*b* may not flow toward the suction space S through the passage to flow toward the discharge hole 105*a* of the cover 105.

Next, referring to FIG. 10, in the case of the scroll compressor 100 according to an embodiment, supply of power applied to the stator 112 may stop. Thus, rotation of the rotational shaft 116 and revolution of the orbiting scroll 130 may stop, stopping a compression operation of the refrigerant. When the compression operation of the refrigerant is stopped, a force to closely attach the fixed wrap 114 to the orbiting wrap 134, that is, a force to closely attach the fixed wrap 114 to the orbiting wrap 134 in the radial direction may be relieved or released. Thus, the sealed compression chamber formed by the fixed wrap 144 and the orbiting wrap 134 may vanish.

In detail, the discharge hole-side refrigerant having a relatively high pressure and the refrigerant within the compression chamber may flow toward the suction space S. A pressure of the wrap space formed by the fixed wrap 144 and the orbiting wrap 134 may converge to a predetermined pressure (equilibrium pressure).

Also, as the relative pressure of the discharge space D temporarily increases, the switching device 108 may move downward to block the discharge hole 145. Thus, it may prevent the refrigerant of the discharge space D from flowing backward to the wrap space through the intermediate discharge hole 158*b* and the discharge hole 145 and reversing the orbiting scroll 130.

As the scroll compressor 100 stops, the orbiting wrap 134 may stop at a predetermined position. As the pressure of the discharge space D is greater than the pressure of the back pressure chamber BP, the refrigerant of the discharge space D may press the floating plate 160 downward. With this process, even though the orbiting wrap 134 is disposed on or at a position at which the intermediate pressure discharge hole 147 is opened (see FIG. 8A), as well as the orbiting wrap 134 is disposed on or at a position at which the intermediate pressure discharge hole 147 is closed (see FIG. 8B), the refrigerant of the back pressure chamber BP may be bypassed to the wrap space through the discharge guide 139.

That is, the refrigerant of the back pressure chamber BP may be introduced into the wrap space through the intermediate pressure suction hole 153 and the intermediate pressure discharge hole 147 to flow into the suction space S. The back pressure chamber BP may be maintained to or at the equilibrium pressure by the flow of the refrigerant. Thus, the floating plate 160 may move downward.

In summary, when the back pressure chamber BP is maintained to or at the equilibrium pressure, and the floating plate 160 moves downward, the rib 164 may be spaced apart from the bottom surface of the cover 105. Thus, the passage between the floating plate 160 and the cover 105 may be opened. As a result, the refrigerant of the cover 105 or the discharge space D may flow toward the suction space S through the passage. The pressure of the cover 105 or the discharge space D may be maintained to or at the equilibrium pressure by the flow of the refrigerant. As a result, as the pressure within the scroll compressor 100 converges, the scroll compressor 100 may quickly re-operate when the scroll compressor 100 re-operates later.

If the refrigerant of the back pressure chamber BP is not introduced into the wrap space to allow the back pressure chamber BP to be maintained to or at the intermediate pressure, when the rib 164 is maintained in contact with the cover 105, and thus, the pressure of the cover 105 and the discharge space D is not maintained to or at the equilibrium pressure, the fixed scroll 140 and the orbiting scroll 130 may be closely attached to each other at an excessive pressure. As a result, it may be difficult to quickly re-operate the scroll compressor. However, this embodiment may solve the above-described limitation. Also, a check valve (not shown) may be disposed in the discharge port 103. Thus, when operation of the scroll compressor 100 is stopped, the check valve may be closed to prevent the refrigerant outside of the scroll compressor 100 from being introduced into the casing 110 through the discharge port 103.

Figure 11:
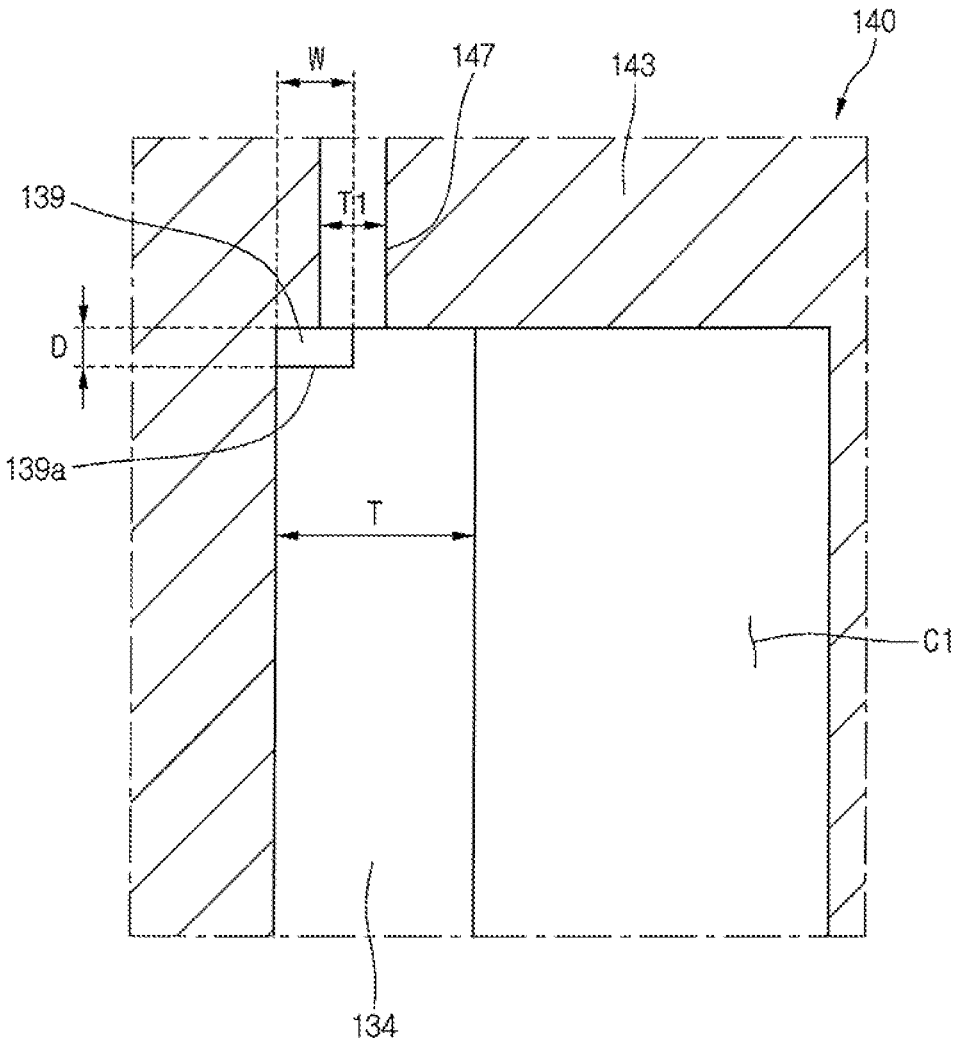
FIG. 11 is a cross-sectional view illustrating the discharge guide of the orbiting scroll according to an embodiment.
Figure 12A:
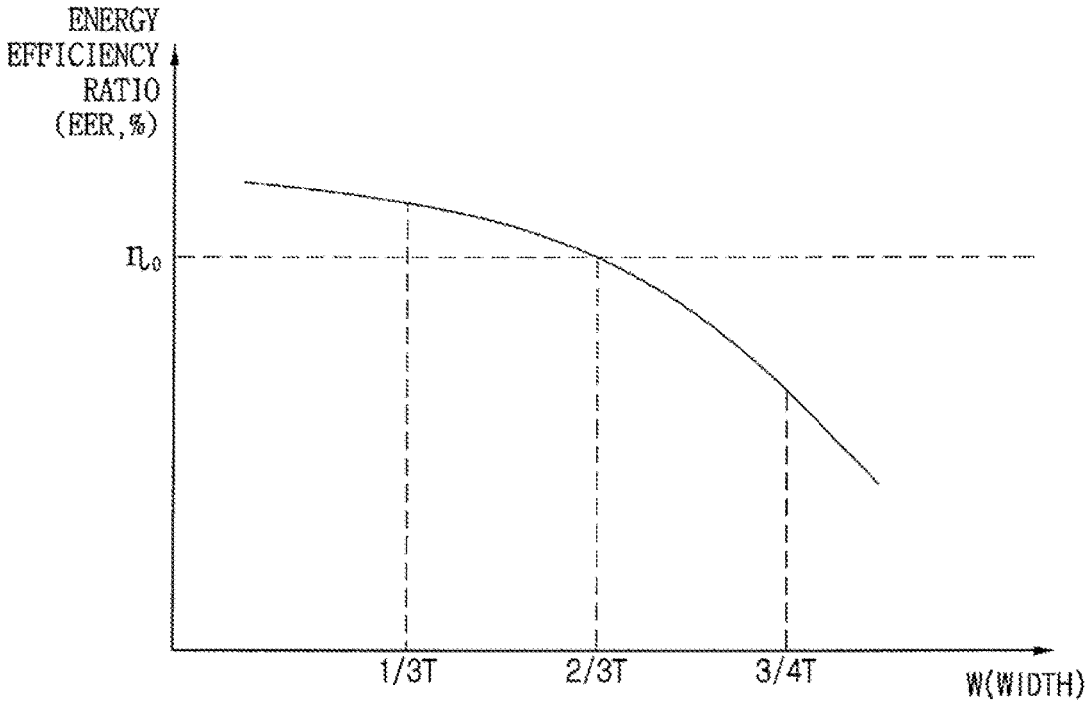
FIGS. 12A and 12B are graphs illustrating a variation in efficiency of the scroll compressor according to a size of the discharge guide.
Figure 12B:
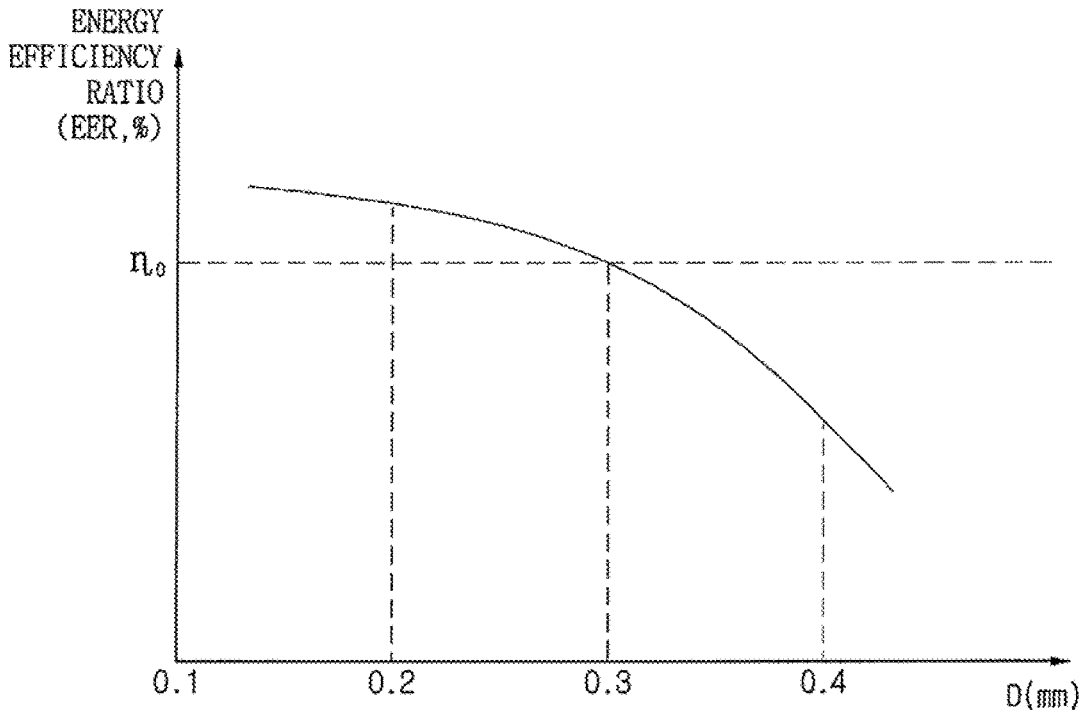

FIG. 11 is a cross-sectional view illustrating the discharge guide of the orbiting scroll according to an embodiment. FIGS. 12A and 12B are graphs illustrating a variation in efficiency of the scroll compressor according to a size of the discharge guide.

Referring to FIG. 11, in the orbiting wrap 134 according to an embodiment, the discharge guide 139 to open the intermediate pressure discharge hole 147 to guide the refrigerant so that the refrigerant is discharged from the intermediate pressure discharge hole 147 to a wrap space C1 may be defined to have a preset or predetermined width W and depth D. The width W may refer to a length in a radial direction of the discharge guide 139, and the depth D may refer to a distance from an end of the intermediate pressure discharge hole 147 to the recessed surface of the discharge guide 139. The wrap space C1 may refer to a space between the orbiting wrap 134 and the fixed wrap 144 in a state in which the compression chamber formed by closely attaching the orbiting wrap 134 to the fixed wrap 144 vanishes after the scroll compressor 100 stops.

The orbiting wrap 134 may have a thickness T greater than a size or thickness T1 of the intermediate pressure discharge hole 147. The size or thickness T1 of the intermediate pressure discharge hole 147 may be a diameter when the intermediate pressure discharge hole 147 has a circular cross-section. Also, when the intermediate pressure discharge hole 147 has an oval or polygonal shape, the size or thickness T1 of the intermediate pressure discharge hole 147 may be a largest width defined in a horizontal (radial) direction.

The discharge guide 139 may have a recessed surface 139*a* formed by being recessed to have the width W and the depth D. A horizontal length of the recessed surface 139*a* may correspond to the width W, and a vertical length of the recessed surface 139*a* may correspond to the depth D.

Although the recessed surface 139*a* is bent in a horizontal or vertical direction in FIG. 11, embodiments are not limited thereto. For example, the recessed surface 139*a* may include a curved shape or portion or have a straight-line shape without being bent.

If the discharge guide 139 has too large a width W or depth D, refrigerant may leak from the compression chamber having a relatively high pressure to the compression chamber having a relatively low pressure among the plurality of compression chambers when the compressor 100 operates, and thus, the scroll compressor may be deteriorated in operation efficiency. Thus, this embodiment proposes a dimension with respect to the width W or depth D of the discharge guide 139 to allow the refrigerant to smoothly flow from the back pressure chamber BP to the wrap space C1 without deteriorating operation efficiency of the scroll compressor. FIGS. 12A and 12B illustrate a graph obtained by repetitive experiments.

Referring to FIG. 12A, a horizontal axis of the graph represents a width W of the discharge guide 139, and a vertical axis represents an energy efficiency ratio (EER) of the compressor. The discharge guide 139 may have a depth D corresponding to a preset or predetermined value (constant value).

In detail, the more the width W of the discharge guide 139 increases, the more a leaking amount of refrigerant while the refrigerant is compressed, that is, a refrigerant leaking amount in an axial direction increases. Thus, the EER of the compressor may be reduced.

Also, to maintain the EER of the scroll compressor 100 to a value greater than a required efficiency ratio ηo, the discharge guide 139 may have a width W less than about 2T/3. When the width W of the discharge guide 139 is less than 2T/3, for example, is 3T/4, it may be seen that the EER of the scroll compressor is reduced by about 30% or more in comparison with the required efficiency ratio ηo.

Next, referring to FIG. 12B, a horizontal axis of the graph represents a depth D of the discharge guide 139, and a vertical axis represents the energy efficiency ratio (EER) of the compressor. The discharge guide 139 may have a width W corresponding to a preset or predetermined value (constant value).

In detail, the more the depth D of the discharge guide 139 increases, the more a leaking amount of refrigerant while the refrigerant is compressed, that is, a refrigerant leaking amount in a radial direction increases. Thus, the EER of the scroll compressor may be reduced.

Also, to maintain the EER of the scroll compressor 100 to a value greater than a required efficiency ratio ηo, the discharge guide 139 may have a depth D less than about 0.3 mm. When the depth D of the discharge guide 139 is less than about 0.3 mm, for example, is about 0.4 mm, it may be seen that the EER of the scroll compressor is reduced by about 30% or more in comparison with the required efficiency ratio ηo.

In summary, the discharge guide 139 may have a depth D of about 0.3 mm or less. Also, the discharge guide 139 may have a width W less by ⅔ times than the thickness T of the orbiting wrap 134.

Figure 13:
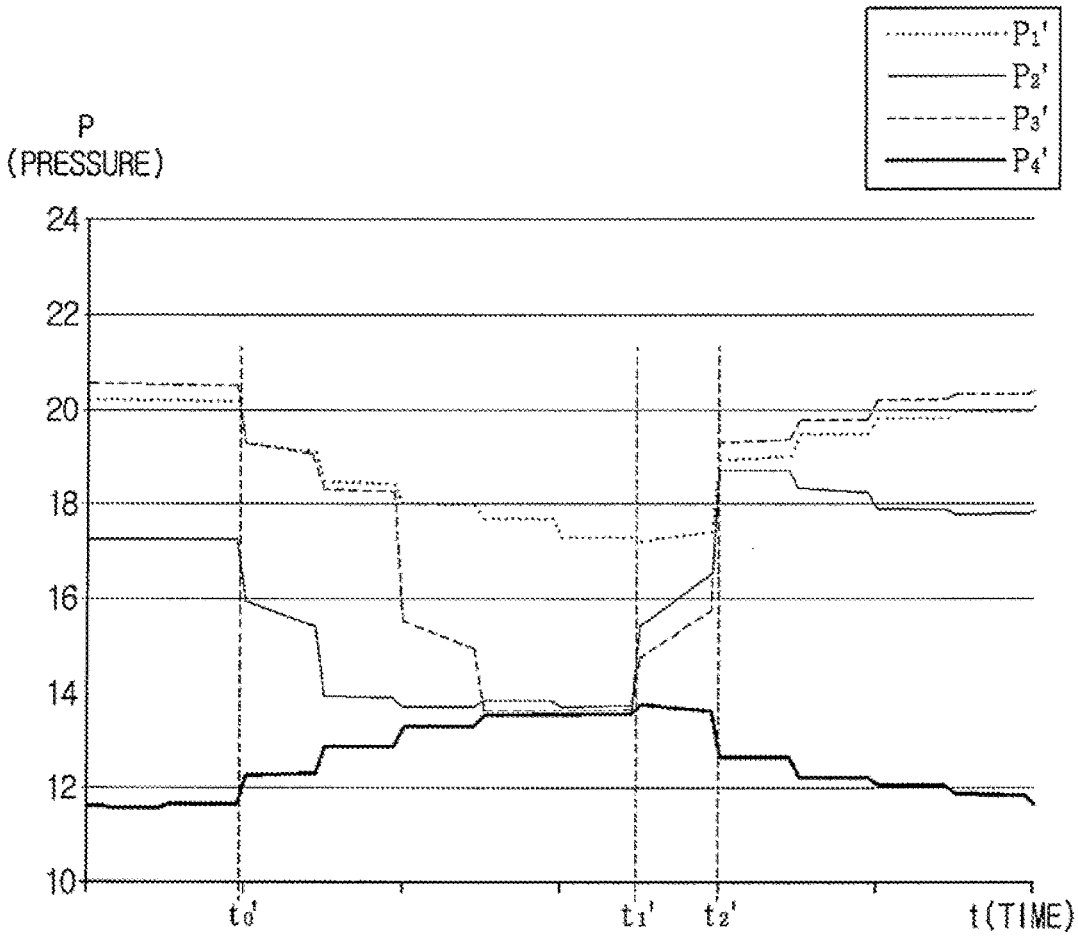
FIG. 13 is a graph illustrating a variation in inner pressure of the scroll compressor according to an embodiment when the scroll compressor stops and then re-operates.

FIG. 13 is a graph illustrating a variation in inner pressure of the scroll compressor when the scroll compressor according to an embodiment stops and then re-operates. Referring to FIG. 13, when the scroll compressor 100 according to an embodiment stops at a time $t_0'$, each of $P_1'$ (a pressure of the refrigerant discharged from the scroll compressor), $P_2'$ (an intermediate pressure of the back pressure chamber), $P_3'$ (a pressure of the cover-side refrigerant), and $P_4'$ (a pressure of the suction-side refrigerant) may gradually converge to an equilibrium pressure.

Also, when a power is applied to the stator 112 at a time $t_1'$ to allow an operation of the scroll compressor to start, the scroll compressor may re-operate at a time $t_2'$ after a short time Δt has elapsed. As a result, a difference in pressure for each position within the scroll compressor may occur. That is, the re-operating time for the scroll compressor may be reduced to quickly perform substantial compression of the refrigerant.

FIGS. 14A to 14D are experimental graphs illustrating a variation in re-operating time according to a ratio of a volume of a discharge space to a volume of a back pressure chamber according to an embodiment. Referring to FIGS. 14A to 14D, a re-operating time of the scroll compressor may vary according to a ratio of the volume V1 of the discharge space D to the volume V2 of the back pressure chamber BP. For example, if the volume V1 is greater by a predetermined ratio or more than the volume V2, the re-operating time of the scroll compressor may be reduced.

As described above, the volume V1 of the discharge space D may be greater by the set ratio than the volume V2 of the back pressure chamber BP so that the pressure of the discharge space D may sufficiently act on the floating plate 160 when the scroll compressor stops. Thus, the refrigerant may be quickly discharged to the suction space D to reduce the time taken to re-operate the scroll compressor.

In detail, FIGS. 14A to 14D illustrate values of times taken to re-operate the scroll compressor after the scroll compressor stops while changing a ratio of the volume V1 to the volume V2. The experiment was performed several times.

Each of graphs of FIGS. 14A to 14D illustrates values of re-operating times varying according to experiment. The time values may be determined on the basis of a fine difference or experimental error of a compression fluid according to the experiment. As illustrated in each of the graphs, it is seen that the re-operating time varies according to the ratio of the volume V1 to the volume V2.

Figure 14A:
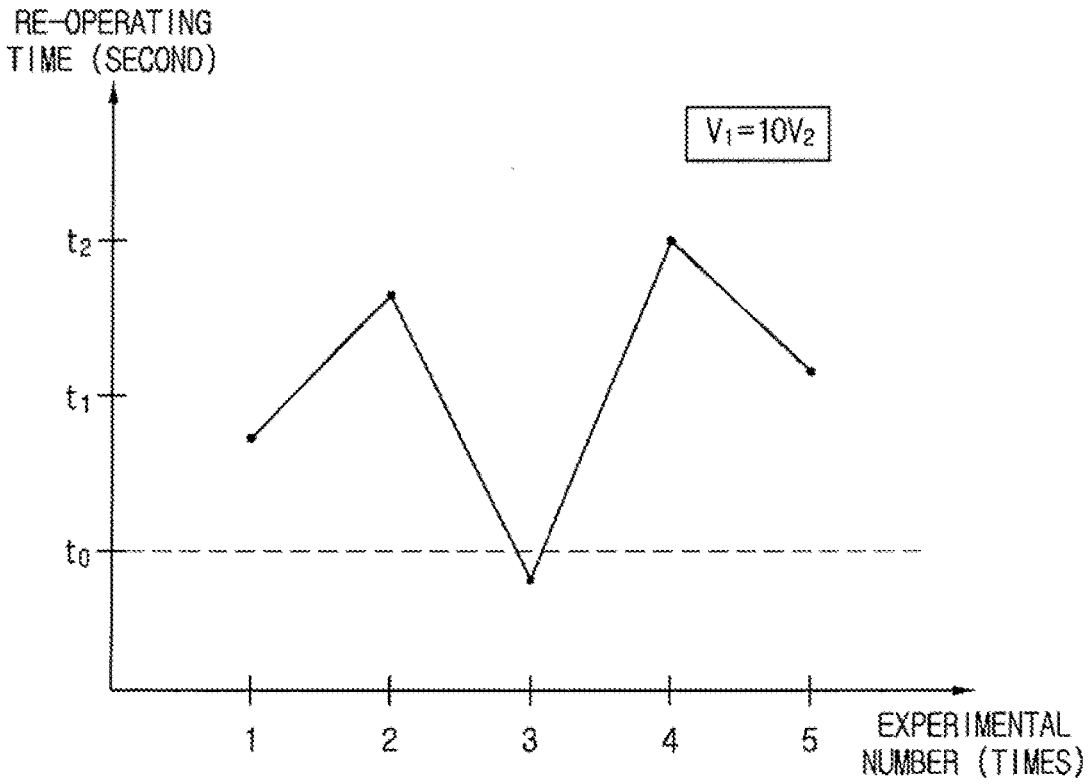
FIGS. 14A to 14D are experimental graphs illustrating a variation in re-operating time according to a ratio of a volume of a discharge space to a volume of a back pressure chamber according to an embodiment.

In detail, when the volume V1 Is greater by 10 times than the volume V2 (V1=10V2), FIG. 14A illustrates values of re-operating times according to experiment. A time $t_0$ may be understood as a set time value that satisfies a quick re-operating condition. For example, the time $t_0$ may be 5 seconds. Also, times $t_1$ and $t_2$ may 10 seconds and 15 seconds, respectively.

FIG. 14A illustrates a case in which the re-operating times respectively correspond to 8, 13, 4, 15, and 10 seconds according to experiment. Thus, it is seen that it is difficult to stably satisfy the required re-operating time to when the volume V1 is greater by 10 times than the volume V2.

Figure 14B:
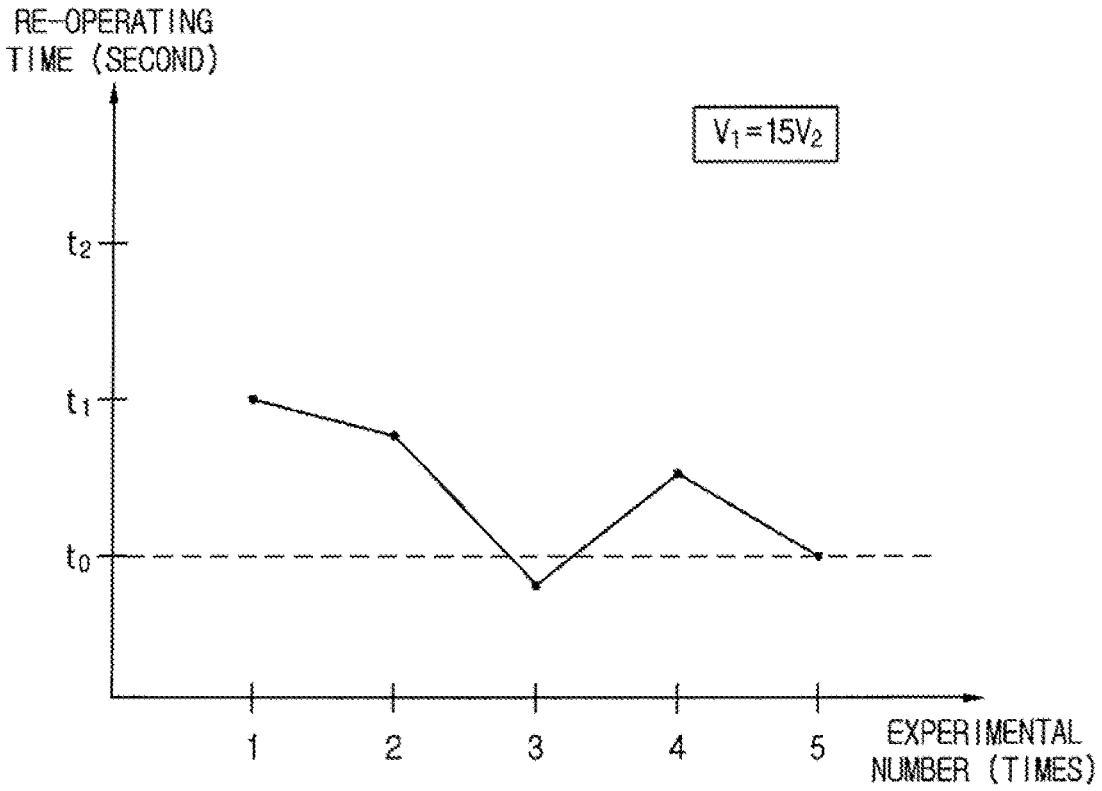

FIG. 14B illustrates a case in which the re-operating times respectively correspond to 10, 8, 3, 7, and 5 seconds according to experiment when the volume V1 is greater by 15 times than the volume V2 (V1=15V2). In this case, even though the scroll compressor quickly re-operates when compared to FIG. 14A, it is seen that it is difficult to stably satisfy the required re-operating time $t_0$.

Figure 14C:
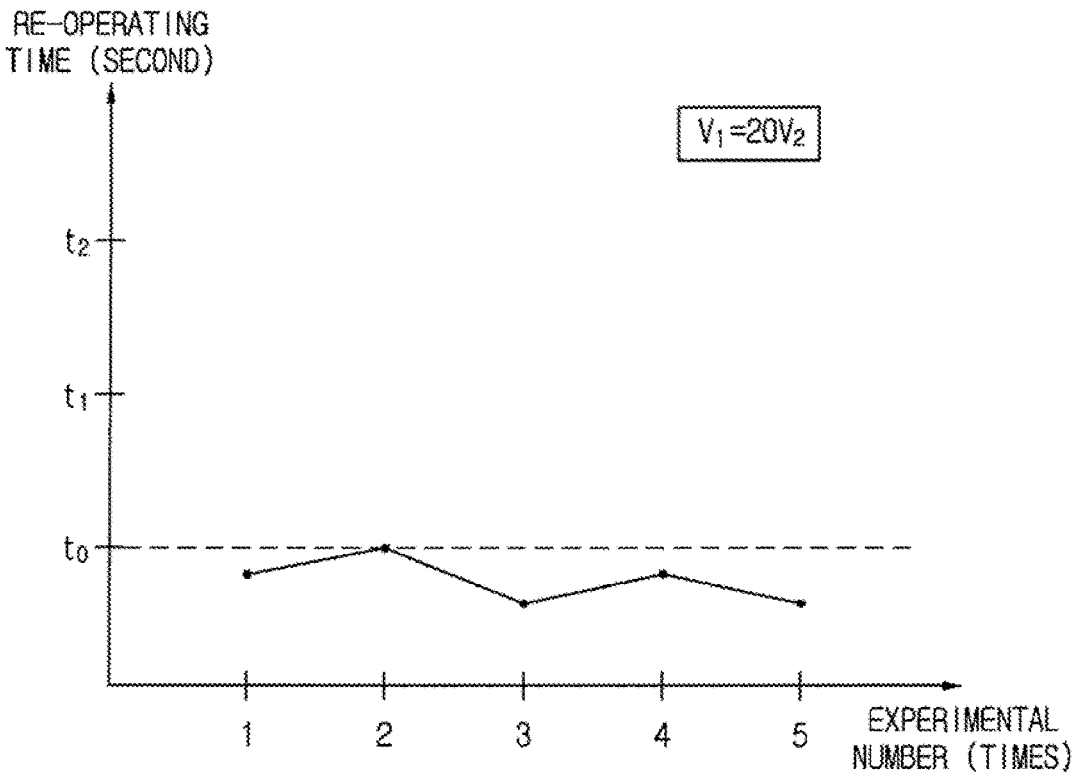

FIG. 14C illustrates a case in which the re-operating times respectively correspond to 4, 5, 3, 4, and 3 seconds according to experiment when the volume V1 is greater by 20 times than the volume V2 (V1=20V2). In this case, it is sent that the scroll compressor quickly re-operates when compared to FIGS. 14A and 14B, and the required re-operating time to is stably satisfied.

Figure 14D:
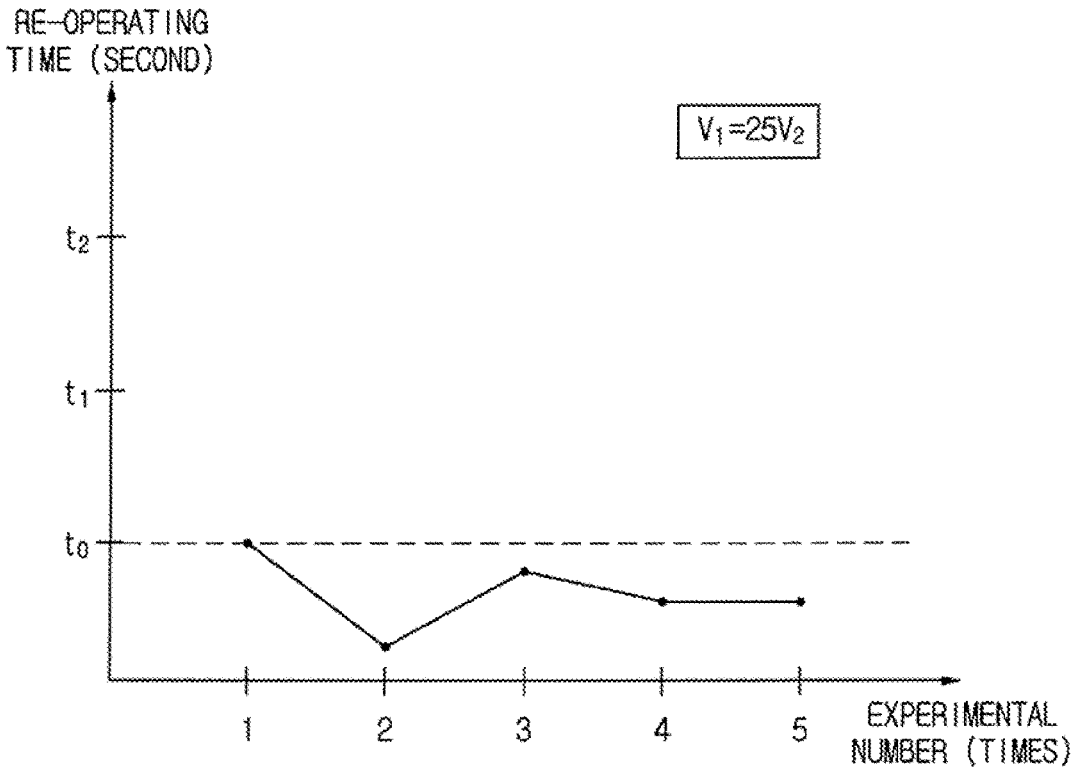

FIG. 14D illustrates a case in which the re-operating times respectively correspond to 5, 2, 4, 3, and 3 seconds according to experiment when the volume V1 is greater by 25 times than the volume V2 (V1=25V2). In this case, it is seen that the scroll compressor quickly re-operates when compared to FIGS. 14A and 14B, and the required re-operating time to is stably satisfied.

As seen through the above-described results, the required re-operating time to is stably satisfied when the volume V1 is greater by 20 times than the volume V2.

According to embodiments disclosed herein, as the back pressure chamber has a volume greater that set ratio in comparison to a volume of the back pressure chamber, the discharge pressure may be sufficiently larger than the pressure of the back pressure chamber. As a result, when the scroll compressor stops, the floating plate may quickly move downward, and thus, the discharge-side refrigerant may be easily discharged to the suction-side.

Also, the discharge guide may be disposed on or at a side of the fixed scroll or the orbiting scroll. Thus, when the scroll compressor stops, the intermediate pressure refrigerant existing in the back pressure chamber may be discharged to the compression chamber-side and the suction-side through the discharge guide. As a result, when the scroll compressor stops, the equilibrium pressure within the compressor may be maintained to allow the scroll compressor to quickly re-operate.

Also, a portion of the wrap of the orbiting scroll or the fixed scroll may be recessed to form the discharge guide. While the orbiting scroll revolves, the back pressure chamber, the discharge guide, and the compression chamber may be disposed to always communicate with each other, thereby preventing the warp of the orbiting scroll from sealing the back pressure chamber.

Also, as the discharge guide is limited to have an optimal width or depth, the discharge of the intermediate pressure refrigerant of the back pressure chamber may be guided. In addition, it may prevent the refrigerant in one compression chamber (the pocket) from leaking into the other compression chamber (the pocket) through the discharge guide.

Embodiments disclosed herein provide a scroll compressor that quickly re-operates by discharging an intermediate pressure refrigerant of a back pressure chamber when the scroll compressor stops.

Embodiments disclosed herein provide a scroll compressor that may include a casing including a rotational shaft; a cover fixed inside of the casing to partition the inside of the casing into a suction space and a discharge space; a first scroll revolved by rotation of the rotational shaft; a second scroll disposed on or at a side of the first scroll to define a plurality of compression chambers together with the first scroll, the second scroll having an intermediate pressure discharge hole that communicates with a compression chamber having an intermediate pressure of the plurality of compression chambers; a back pressure part or plate coupled to the second scroll, the back pressure part having an intermediate pressure suction hole that communicates with the intermediate pressure discharge hole; and a floating plate movably disposed on or at a side of the back pressure part to define the back pressure chamber (BP) together with the back pressure part. The discharge space (D) may have a volume greater by a set or predetermined ratio or more than a volume (V2) of the back pressure chamber (BP). The set ratio may be 20 times.

The scroll compressor may further include a discharge guide part or guide disposed on the first or second scroll to discharge a refrigerant into the back pressure chamber when compression of the refrigerant stops. The first scroll may include a first head plate coupled to the rotational shaft, and a first wrap that extends from the first head plate in one direction. The discharge guide part may include a recess part or recess formed by recessing at least a portion of the first wrap.

The second scroll may include a second head plate coupled to the back pressure part, and a second wrap that extends from the second head plate to the first head plate. The recess part may be defined in one surface of the first wrap, which faces the second head plate.

The scroll compressor may further include a discharge hole defined in the second scroll to discharge a refrigerant having a discharge pressure, which is compressed in the plurality of compression chambers, and an intermediate discharge hole defined in the back pressure part to communicate with the discharge hole, thereby guiding the refrigerant toward the cover. The scroll compressor may further include a switching device movably disposed on or at a side of the discharge hole. The switching device may open the discharge hole while the refrigerant is compressed and close the discharge hole when compression of the refrigerant stops.

The back pressure part may include a support supported by the second head plate of the second scroll, the support having a hollow annular shape; a first wall that extends from an inner circumferential surface of the support, the first wall having a cylindrical shape; and a second wall that extends from an outer circumferential surface of the support, the second wall having a cylindrical shape. The back pressure chamber (BP) may be a space, which is covered by the floating plate, defined by the first wall, the second wall, and the support part.

The back pressure part may further include a third wall that accommodates at least a portion of the switching device, the third wall being disposed to be spaced inward from the second wall; and a top surface part or surface disposed on a side of the third wall to restrict movement of the switching device. A discharge pressure apply hole to apply a pressure of the discharge space to the switching device to allow the switching device to move may be defined in the top surface part.

The floating plate may further include a rib that protrudes to the cover. The rib may contact the cover while a refrigerant is compressed and be away from the cover when compression of the refrigerant stops.

Embodiments disclosed herein further provide a scroll compressor that may include a casing; a cover fixed inside of the casing to partition the inside of the casing into a suction space and a discharge space; a main frame disposed to be space apart from the cover, a first scroll placed on the main frame to revolve; a second scroll placed on the first scroll to define a plurality of compression chambers together with the first scroll, the second scroll having a discharge hole through which a compressed refrigerant is discharged; a back pressure part or plate coupled to the second scroll, the back pressure part including a switching device to selectively open and close the discharge hole; a floating plate movably disposed on the back pressure part; and a back pressure chamber defined between the back pressure part and the floating plate. The cover may include a discharge hole to guide a flow of the refrigerant so that the refrigerant of the discharge space presses the floating plate at a set or predetermined pressure or more when compression of the refrigerant stops.

The set pressure may correspond to a pressure that acts when a volume of the discharge space is greater by 20 times than a volume of the back pressure chamber. The scroll compressor may further include a rib that protrudes from a top surface of the floating plate and spaced apart from the cover when the refrigerant of the discharge space, which flows through the discharge hole, presses the floating plate.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing comprising a rotational shaft;

a cover fixed inside of the casing to partition the inside of the casing into a suction space and a discharge space;

a first scroll that is revolved by rotation of the rotational shaft;

a second scroll disposed at a side of the first scroll to define a plurality of compression chambers together with the first scroll when the first scroll revolves, the second scroll having an intermediate pressure discharge hole that communicates with a compression chamber having an intermediate pressure of the plurality of compression chambers;

a back pressure plate coupled to the second scroll, the back pressure plate having an intermediate pressure suction hole that communicates with the intermediate pressure discharge hole; and a floating plate movably disposed at a side of the back pressure portion to define a back pressure chamber together with the back pressure plate, wherein the discharge space has a volume greater by 20 times or more than a volume of the back pressure chamber.

2. The scroll compressor according to claim 1, further comprising a discharge guide disposed on the first scroll to discharge a refrigerant within the back pressure chamber when compression of the refrigerant stops.

3. The scroll compressor according to claim 2, wherein the first scroll comprises a first head plate coupled to the rotational shaft, and a first wrap that extends from the first head plate in one direction, and wherein the discharge guide comprises a recess formed by recessing at least a portion of the first wrap.

4. The scroll compressor according to claim 3, wherein the second scroll comprises a second head plate coupled to the back pressure plate, and a second wrap that extends from the second head plate to the first head plate, and wherein the recess is defined in a surface of the first wrap that faces the second head plate.

5. The scroll compressor according to claim 1, further comprising:

a discharge hole defined in the second scroll to discharge a refrigerant having a discharge pressure, which is compressed in the plurality of compression chambers; and an intermediate discharge hole defined in the back pressure plate to communicate with the discharge hole, thereby guiding the refrigerant toward the discharge space.

6. The scroll compressor according to claim 5, further comprising a switching device movably disposed at a side of the discharge hole, wherein the switching device opens the discharge hole while the refrigerant is compressed and closes the discharge hole when compression of the refrigerant stops.

7. The scroll compressor according to claim 6, wherein the back pressure plate comprises:

a support supported by the second scroll, the support having a hollow annular shape;

a first wall that extends from an inner circumferential surface of the support, the first wall having a cylindrical shape; and a second wall that extends from an outer circumferential surface of the support, the second wall having a cylindrical shape.

8. The scroll compressor according to claim 7, wherein the back pressure chamber is a space covered by the floating plate and defined by the first wall, the second wall, and the support.

9. The scroll compressor according to claim 7, wherein the back pressure plate comprises:

a third wall that accommodates at least a portion of the switching device, wherein the third wall is spaced inward from the second wall; and a top surface disposed at a side of the third wall to restrict movement of the switching device.

10. The scroll compressor according to claim 9, further comprising a discharge pressure apply hole defined in the top surface to apply a pressure of the discharge space to the switching device to allow the switching device to move.

11. The scroll compressor according to claim 1, wherein the floating plate comprises a rib that protrudes towards the cover, and wherein the rib contacts the cover when the refrigerant is compressed and is disposed away from the cover when compression of the refrigerant stops.

12. The scroll compressor according to claim 1, wherein the first scroll comprises an orbiting scroll and the second scroll comprises a fixed scroll.

13. A scroll compressor, comprising:

a casing;

a cover fixed inside of the casing to partition the inside of the casing into a suction space and a discharge space;

a main frame disposed to be spaced apart from the cover;

a first scroll disposed on the main frame and configured to revolve;

a second scroll disposed on the first scroll to define a plurality of compression chambers together with the first scroll when the first scroll revolves, wherein the second scroll has a first discharge hole through which a compressed refrigerant is discharged;

a back pressure plate coupled to the second scroll, wherein the back pressure plate comprises a switching device to selectively open and close the first discharge hole;

a floating plate movably disposed on the back pressure plate; and a back pressure chamber defined between the back pressure plate and the floating plate, wherein the cover comprises a second discharge hole to guide a flow of the refrigerant such that the refrigerant of the discharge space presses the floating plate at a predetermined pressure or more when compression of the refrigerant stops, and wherein the predetermined pressure corresponds to a pressure that acts when a volume of the discharge space is greater by 20 times than a volume of the back pressure chamber.

14. The scroll compressor according to claim 13, further comprising a rib that protrudes from a top surface of the floating plate, wherein the rib is spaced apart from the cover when the refrigerant of the discharge space, which flows through the second discharge hole, presses the floating plate.

15. The scroll compressor according to claim 13, wherein the first scroll comprises an orbiting scroll and the second scroll comprises a fixed scroll.

16. A scroll compressor, comprising:

a casing comprising a rotational shaft;

a cover fixed inside of the casing to partition the inside of the casing into a suction space and a discharge space;

an orbiting scroll that is revolved by rotation of the rotational shaft;

a fixed scroll disposed at a side of the orbiting scroll to define a plurality of compression chambers together with the orbiting scroll when the first scroll revolves, the fixed scroll having an intermediate pressure discharge hole that communicates with a compression chamber having an intermediate pressure of the plurality of compression chambers; and a back pressure assembly coupled to the fixed scroll, the back pressure assembly forming a back pressure chamber having an intermediate pressure suction hole that communicates with the intermediate pressure discharge hole, wherein the discharge space has a volume greater by 20 times or more than a volume of the back pressure chamber.

17. The scroll compressor according to claim 16, further comprising a discharge guide disposed on the orbiting scroll to discharge a refrigerant within the back pressure chamber when compression of the refrigerant stops.

18. The scroll compressor according to claim 17, wherein the orbiting scroll comprises an orbiting head plate coupled to the rotational shaft, and a orbiting wrap that extends from the orbiting head plate in one direction, and wherein the discharge guide comprises a recess formed by recessing at least a portion of the orbiting wrap.

19. The scroll compressor according to claim 18, wherein the fixed scroll comprises a fixed head plate coupled to the back pressure assembly, and a fixed wrap that extends from the fixed head plate to the orbiting head plate, and wherein the recess is defined in a surface of the orbiting wrap that faces the fixed head plate.

20. The scroll compressor according to claim 16, wherein the back pressure assembly comprises a back pressure plate, and wherein the back pressure plate comprises:

a support supported by the second scroll, the support having a hollow annular shape;

a first wall that extends from an inner circumferential surface of the support, the first wall having a cylindrical shape; and a second wall that extends from an outer circumferential surface of the support, the second wall having a cylindrical shape.

21. The scroll compressor according to claim 20, wherein the back pressure assembly further comprises a floating plate, and wherein the back pressure chamber is a space covered by the floating plate and defined by the first wall, the second wall, and the support.

22. A scroll compressor, comprising:

a casing comprising a rotational shaft;

a cover fixed inside of the casing to partition the inside of the casing into a suction space and a discharge space;

a first scroll that is revolved by rotation of the rotational shaft;

a second scroll disposed at a side of the first scroll to define a plurality of compression chambers together with the first scroll when the first scroll revolves, the second scroll having an intermediate pressure discharge hole that communicates with a compression chamber having an intermediate pressure of the plurality of compression chambers;

a back pressure plate coupled to the second scroll, the back pressure plate having an intermediate pressure suction hole that communicates with the intermediate pressure discharge hole;

a floating plate movably disposed at a side of the back pressure portion to define a back pressure chamber together with the back pressure plate, wherein the discharge space has a volume greater by a predetermined ratio or more than a volume of the back pressure chamber;

a discharge hole defined in the second scroll to discharge a refrigerant having a discharge pressure, which is compressed in the plurality of compression chambers;

an intermediate discharge hole defined in the back pressure plate to communicate with the discharge hole, thereby guiding the refrigerant toward the discharge space; and a switching device movably disposed at a side of the discharge hole, wherein the switching device opens the discharge hole while the refrigerant is compressed and closes the discharge hole when compression of the refrigerant stops, wherein the back pressure plate comprises:

a support supported by the second scroll, the support having a hollow annular shape;

a first wall that extends from an inner circumferential surface of the support, the first wall having a cylindrical shape;

a second wall that extends from an outer circumferential surface of the support, the second wall having a cylindrical shape;

a third wall that accommodates at least a portion of the switching device, wherein the third wall is spaced inward from the second wall; and a top surface disposed at a side of the third wall to restrict movement of the switching device.

* * * * *